US011731851B2

(12) United States Patent
Fujita

(10) Patent No.: US 11,731,851 B2
(45) Date of Patent: Aug. 22, 2023

(54) POST-PROCESSOR AND IMAGE FORMING SYSTEM

(71) Applicant: Konica Minolta, Inc., Tokyo (JP)

(72) Inventor: Yuji Fujita, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/706,367

(22) Filed: Mar. 28, 2022

(65) Prior Publication Data

US 2022/0324673 A1 Oct. 13, 2022

(30) Foreign Application Priority Data

Apr. 7, 2021 (JP) ..... 2021-065347

(51) Int. Cl.
*B65H 39/10* (2006.01)
*B65H 37/04* (2006.01)
*B65H 43/00* (2006.01)

(52) U.S. Cl.
CPC ..... *B65H 37/04* (2013.01); *B65H 39/10* (2013.01); *B65H 43/00* (2013.01); *B65H 2801/03* (2013.01)

(58) Field of Classification Search
CPC ..... G03G 2215/00717; B65H 9/20; B65H 43/00; B65H 31/34; B65H 2408/114; B65H 2408/1142; B65H 2301/362; B65H 2301/363
USPC ..... 270/58.04, 58.12, 58.17, 58.27
See application file for complete search history.

(56) References Cited

U.S. PATENT DOCUMENTS

| | | | | |
|---|---|---|---|---|
| 7,681,881 | B2 * | 3/2010 | Kunieda | B65H 31/38 271/220 |
| 8,950,745 | B2 * | 2/2015 | Takahashi | G03G 15/6538 270/58.27 |
| 9,128,438 | B2 * | 9/2015 | Atay | H04N 1/00074 |
| 9,828,203 | B2 * | 11/2017 | Kubota | B65H 31/3027 |
| 10,479,636 | B2 * | 11/2019 | Nakano | B65H 43/00 |
| 2012/0020715 | A1 * | 1/2012 | Takahashi | G03G 15/6538 399/407 |

FOREIGN PATENT DOCUMENTS

| | | | | |
|---|---|---|---|---|
| JP | H10-226458 A | | 8/1998 | |
| JP | 2007084343 A | * | 4/2007 | B41F 21/00 |

OTHER PUBLICATIONS

Espacenet machine translation of JP2007084343A; http://translationportal.epo.org/emtp/translate/?ACTION=description-retrieval&COUNTRY=JP&ENGINE=google&FORMAT=docdb&KIND=A&LOCALE=en_EP&NUMBER=2007084343&OPS=ops.epo.org/3.2&SRCLANG=ja&TRGLANG=en (Year: 2007).*

(Continued)

*Primary Examiner* — Leslie A Nicholson, III
(74) *Attorney, Agent, or Firm* — Squire Patton Boggs (US) LLP

(57) ABSTRACT

To provide a post-processor capable of executing alignment processing with high accuracy.

Configuring a post-processor including: a recording material loader on which a recording material conveyed through a conveyance path is loaded; an aligner that aligns the recording material in the recording material loader; a driver that moves the aligner; and a controller that receives information of a physical property value of the recording material acquired by a medium sensor and determines an operation parameter of alignment processing that drives the driver based on the information of the physical property value.

18 Claims, 18 Drawing Sheets

(56) References Cited

OTHER PUBLICATIONS

Xin-She Yang, "Engineering Mathematics with Examples and Applications", Elsevier, Academic Press, 2017, section 28.5.7, "Learned Models," 24 pages.

* cited by examiner

FIG. 10

| INPUT CONDITION | | | | | | | | | | | OPERATION PARAMETER | | | | |
|---|---|---|---|---|---|---|---|---|---|---|---|---|---|---|---|
| SMOOTHNESS | CHARGE AMOUNT | RIGIDITY | WATER CONTENT | PAPER GRAIN | BASIS WEIGHT | SIZE | TYPE | PRINTING SURFACE | NUMBER OF LOADED PAPERS | COVERAGE | NUMBER OF TIMES OF MOVEMENT | AMOUNT OF MOVEMENT | MOVING SPEED | DRIVE TORQUE | ALIGNMENT RESULT |
| 1185.3 | | 4.63 | | SHORT | 84.9 | A4 | ART PAPER | ONE SIDE | 413 | 32 | 3 | 1 | 2 | 1 | 0 |
| 1185.3 | | 4.63 | | SHORT | 84.9 | A4 | ART PAPER | ONE SIDE | 397 | 6 | 2 | −3 | 0 | 2 | 1 |
| 1185.3 | | 4.63 | | SHORT | 84.9 | A4 | ART PAPER | ONE SIDE | 363 | 7 | 2 | −2 | 0 | 1 | 1 |
| 1185.3 | | 4.63 | | SHORT | 84.9 | A4 | ART PAPER | ONE SIDE | 262 | 34 | 5 | 1 | 2 | 0 | 1 |
| 1185.3 | | 4.63 | | SHORT | 84.9 | A4 | ART PAPER | TWO SIDES | 681 | 3 | 2 | 1 | 1 | 2 | 1 |
| 1185.3 | | 4.63 | | SHORT | 84.9 | A4 | ART PAPER | ONE SIDE | 945 | 13 | 4 | 0 | 2 | 2 | 1 |
| 1185.3 | | 4.63 | | SHORT | 84.9 | A4 | ART PAPER | TWO SIDES | 731 | 34 | 3 | 0 | 1 | 0 | 0 |
| 1185.3 | | 4.63 | | SHORT | 84.9 | A4 | ART PAPER | ONE SIDE | 429 | 5 | 3 | 0 | 0 | 1 | 0 |
| 1185.3 | | 4.63 | | SHORT | 84.9 | A4 | ART PAPER | TWO SIDES | 839 | 20 | 4 | 0 | 0 | 1 | 1 |
| 1185.3 | | 4.63 | | SHORT | 84.9 | A4 | ART PAPER | ONE SIDE | 163 | 7 | 5 | −2 | 0 | 2 | 0 |
| 40.7 | | 10.85 | | LONG | 64 | A3 | PLAIN PAPER | ONE SIDE | 974 | 18 | 4 | −3 | 2 | 0 | 0 |
| 40.7 | | 10.85 | | LONG | 64 | A3 | PLAIN PAPER | ONE SIDE | 534 | 26 | 2 | 0 | 0 | 0 | 0 |
| 40.7 | | 10.85 | | LONG | 64 | A3 | PLAIN PAPER | ONE SIDE | 364 | 11 | 5 | −1 | 0 | 0 | 0 |
| 40.7 | | 10.85 | | LONG | 64 | A3 | PLAIN PAPER | TWO SIDES | 991 | 14 | 4 | 1 | 2 | 1 | 0 |
| 40.7 | | 10.85 | | LONG | 64 | A3 | PLAIN PAPER | ONE SIDE | 167 | 35 | 2 | −1 | 2 | 0 | 1 |
| 40.7 | | 10.85 | | LONG | 64 | A3 | PLAIN PAPER | TWO SIDES | 354 | 35 | 2 | 1 | 0 | 1 | 0 |
| 40.7 | | 10.85 | | LONG | 64 | A3 | PLAIN PAPER | TWO SIDES | 186 | 8 | 5 | −2 | 1 | 1 | 1 |
| 40.7 | | 10.85 | | LONG | 64 | A3 | PLAIN PAPER | ONE SIDE | 667 | 3 | 5 | −1 | 2 | 1 | 0 |
| 40.7 | | 10.85 | | LONG | 64 | A3 | PLAIN PAPER | ONE SIDE | 61 | 26 | 1 | −2 | 2 | 0 | 0 |
| 40.7 | | 10.85 | | LONG | 64 | A3 | PLAIN PAPER | ONE SIDE | 796 | 16 | 5 | 0 | 2 | 2 | 1 |

POST-PROCESSOR AND IMAGE FORMING SYSTEM

CROSS-REFERENCE TO RELATED APPLICATIONS

The entire disclosure of Japanese patent Application No. 2021-65347, filed on Apr. 7, 2021, is incorporated herein by reference in its entirety.

BACKGROUND

Technological Field

The present invention relates to a post-processor and an image forming system including the post-processor.

Description of the Related Art

A post-processor that performs post-processing such as staple processing and punching on a recording material on which an image is formed is known. In the post-processor, the post-processing is performed on the recording material in a state of being loaded on a loader. In order to perform the post-processing, it is necessary to perform processing of jogging the ends of the loaded recording materials (alignment processing). Therefore, the post-processor includes an aligner for aligning the ends of the recording materials stacked on the recording material loader. The post-processor executes the alignment processing by moving the aligner toward the recording materials from the direction on the side where the ends of the recording materials are aligned and moving the recording materials such that the ends are aligned.

As the post-processor including the aligner, a configuration has been proposed in which operation parameters of alignment processing are determined from the loading amount, the size, the material, and the like of recording material (see, for example, Patent Literature 1). The post-processor having this configuration uses a sheet type detection sensor capable of detecting the type of a recording material to detect the paper type of the recording material such as high-quality paper or recycled paper, and the operation parameters of the alignment processing are determined.

RELATED ART LITERATURE

Patent Literature

Patent Literature 1: JP H10-226458 A

SUMMARY

However, it is difficult to perform the alignment processing with high accuracy only by determining the operation parameters of the alignment processing according to the type of the sheet (recording material) as in the above-described post-processor. For example, even for the same sheet type, the surface state, volume, weight, and the like of the sheet may change depending on the environment such as temperature and humidity. In the alignment processing, when the alignment force is too strong with respect to the recording material in such a state, buckling such as deflection or bending tends to occur in the recording material, so that the accuracy of the alignment processing is deteriorated. In addition, in a case where the alignment force is weak, the loaded recording material cannot be sufficiently moved, and the accuracy of the alignment processing is deteriorated.

In order to solve the above-described problems, the present invention provides a post-processor capable of executing alignment processing with high accuracy, and an image forming system.

A post-processor of the present invention includes: a recording material loader on which a recording material conveyed through a conveyance path is loaded; an aligner that aligns the recording material in the recording material loader; a driver that moves the aligner; and a controller that receives information of a physical property value of the recording material acquired by a medium sensor and determines an operation parameter of alignment processing that drives the driver based on the information of the physical property value.

In addition, an image forming system of the present invention is an image forming system including an image forming apparatus and the post-processor, the image forming system including: an image former that forms an image on a recording material and is provided in the image forming apparatus; a recording material loader on which the recording material conveyed from the image former through a conveyance path is loaded and that is provided in the post-processor; an aligner that aligns at least one end of leading and trailing ends in a direction parallel to a conveyance direction of the recording material and side ends in a direction orthogonal to the conveyance direction in the recording material loader and is provided in the post-processor; a driver that moves the aligner and is provided in the post-processor; a medium sensor that acquires a physical property value of the recording material and is provided in at least one of the image forming apparatus and the post-processor; and a controller that determines an operation parameter of alignment processing that drives the driver based on information of the physical property value of the recording material acquired by the medium sensor.

According to an embodiment of the present invention, a post-processor capable of executing alignment processing with high accuracy and an image forming system can be provided.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is an example of a data table of an alignment history stored in a parameter storage;

DETAILED DESCRIPTION OF EMBODIMENTS

Hereinafter, one or more embodiments of the present invention will be described with reference to the drawings. However, the scope of the invention is not limited to the disclosed embodiments.

Hereinafter, examples of modes for carrying out the present invention will be described, but the present invention is not limited to the examples described below.

Note that the description will be given in the order described below.

1. First embodiment of the image forming system and the post-processor

2. Configurations of the post-processor and the aligner

3. Second embodiment of the image forming system and the post-processor

<1. First Embodiment of the Image Forming System and the Post-Processor>

Hereinafter, a specific embodiment (first embodiment) of the image forming system and the post-processor included in the image forming system will be described.

Figure 1:
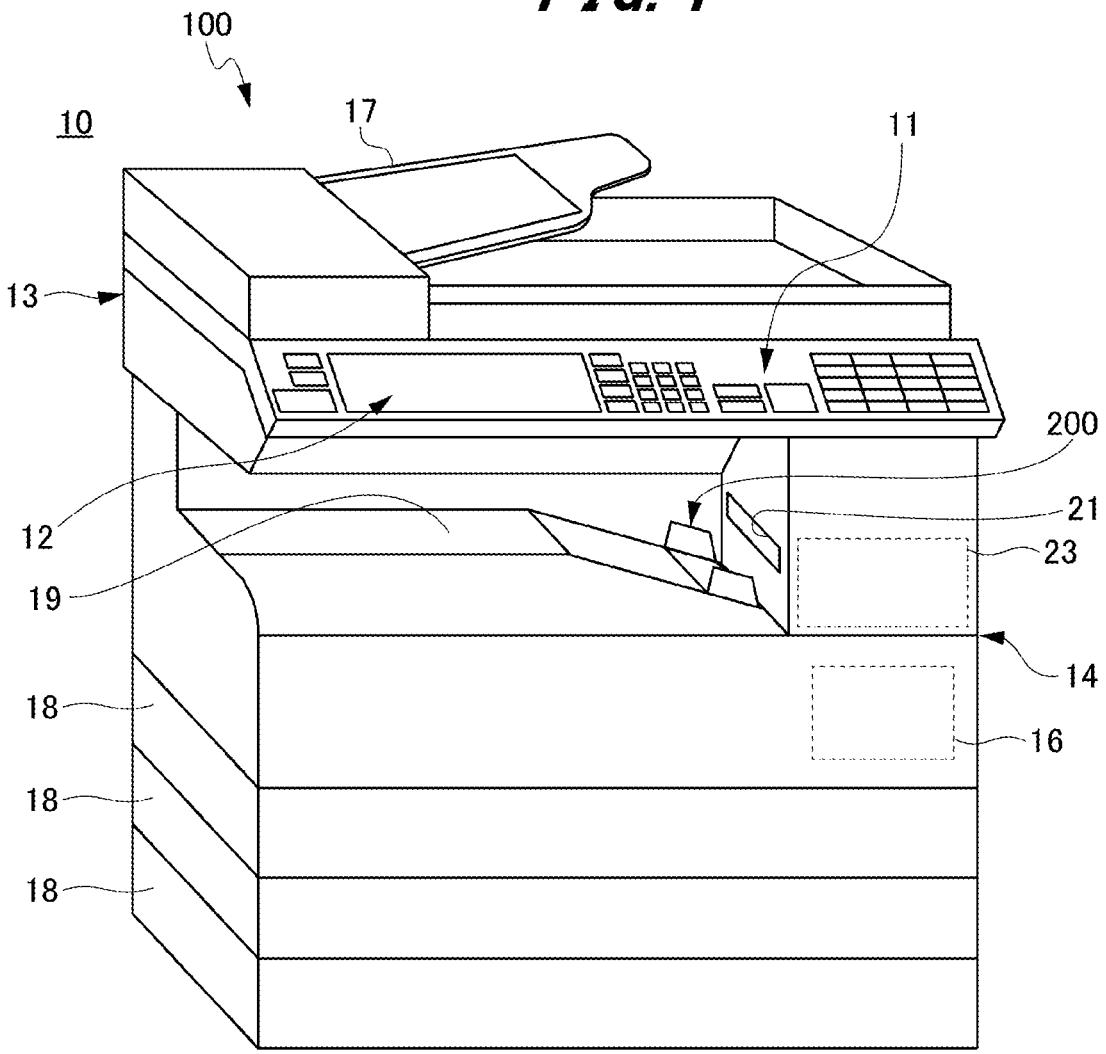
FIG. 1 is a schematic configuration diagram of an image forming system including a post-processor.

FIG. 1 illustrates a schematic configuration diagram of the image forming system including the post-processor. An image forming system 10 illustrated in FIG. 1 includes an image forming apparatus 100 and a post-processor 200. The image forming apparatus 100 is a multifunction peripheral having functions such as copying, scanning, printing, and facsimile, and has a configuration capable of transmitting and receiving data via a network. The post-processor 200 performs processing (hereinafter, simply referred to as alignment or alignment processing) of moving the end of the recording material ejected from the image forming apparatus 100 to a predetermined position on the recording material loader.

As illustrated in an external diagram of the image forming system 10 in FIG. 1, the image forming apparatus 100 constituting the image forming system 10 includes an operator 11, a display 12, an image reader 13, and an image former 14 as main configurations.

In addition, an auto document feeder (ADF) 17 that automatically sends a document to the image reader 13 is disposed above the image forming apparatus 100. A plurality of paper feeders 18 for supplying a recording material to the image former 14 is disposed below the image forming apparatus 100. A paper ejection port 21 through which a recording material on which an image is formed is ejected and a paper ejection tray 19 on which the recording material discharged through the paper ejection port 21 is loaded are disposed in a central portion of the image forming apparatus 100.

In addition, in the image forming apparatus 100, the post-processor 200 is provided on the paper ejection tray 19 immediately after the paper ejection port 21. The post-processor 200 performs the alignment processing on the loaded recording material on the paper ejection tray 19, which is a recording material loader on which the recording material conveyed on the conveyance path is loaded.

Furthermore, inside the image forming apparatus 100, a communicator 16 that transmits and receives image data and the like to and from external equipment via a network, and an information processor 23 that integrally controls the image forming apparatus 100 are provided. The communicator 16 executes transmission and reception of various data with respect to the external equipment via a network interface, which is not illustrated.

In the image forming apparatus 100 illustrated in FIG. 1, the operator 11 includes a plurality of keys, and accepts various instructions by a user's operation on the keys and inputs of data such as characters and numbers.

The display 12 displays an instruction menu for the user, information regarding the acquired image, and the like.

The image reader 13 photoelectrically reads image information such as a photograph, a character, and a picture from a document to acquire image data. The acquired image data (concentration data) is converted into digital data in an image processor, which is not illustrated, subjected to various types of known image processing, and then sent to the image former 14 and the communicator 16 so as to be used for image formation and data transmission. In addition, it is stored in the information processor 23 for later use. Details of the configuration of the information processor 23 will be described below.

The communicator 16 transmits and receives facsimile data via a public telephone line and also transmits and receives data to and from the external equipment connected to a network via the network such as a LAN or the Internet.

The image former 14 forms an image on the recording material based on the acquired image data. The image former 14 acquires image data used for image formation from, for example, image data acquired by the image reader 13, image data received from the external equipment by the communicator 16, image data stored in the information processor 23, and the like.

[Configuration of the Image Former]

Figure 2:
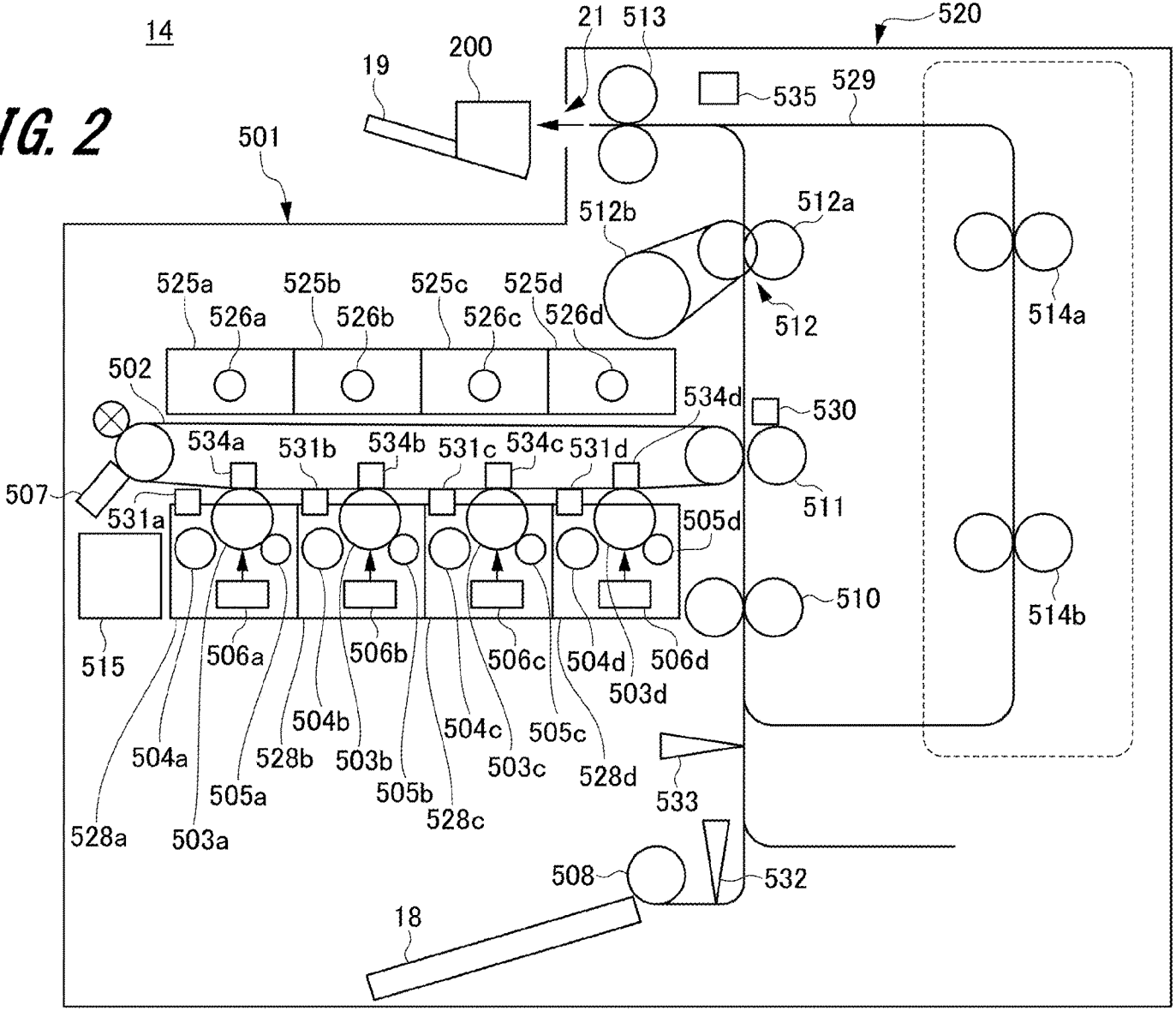
FIG. 2 is a diagram illustrating an internal configuration of an image former of an image forming apparatus.

FIG. 2 illustrates an internal configuration of the image former 14 of the image forming apparatus 100. The image forming apparatus 100 includes an imager 501, a conveyor 520, and a medium sensor 533 as main configurations.

The imager 501 includes cartridges 528*a*, 528*b*, 528*c*, and 528*d*, and an intermediate transfer belt 502.

The cartridges 528*a*, 528*b*, 528*c*, and 528*d* respectively incorporate photoconductors 503*a*, 503*b*, 503*c*, and 503*d*, chargers 505*a*, 505*b*, 505*c*, and 505*d*, exposurers 506*a*, 506*b*, 506*c*, and 506*d*, and developers 504*a*, 504*b*, 504*c*, and 504*d*.

The chargers 505*a*, 505*b*, 505*c*, and 505*d* charge the photoconductors 503*a*, 503*b*, 503*c*, and 503*d*. The exposurers 506*a*, 506*b*, 506*c*, and 506*d* expose image patterns on the photoconductors 503*a*, 503*b*, 503*c*, and 503*d* to form electrostatic latent images. The developers 504*a*, 504*b*, 504*c*, and 504*d* supply toner to the electrostatic latent images formed on the photoconductors 503*a*, 503*b*, 503*c*, and 503*d* to form toner images.

In addition, the imager 501 includes toner bottles 525*a*, 525*b*, 525*c*, and 525*d* that supply toner to the developers 504*a*, 504*b*, 504*c*, and 504*d*. The toner bottles 525*a*, 525*b*, 525*c*, and 525*d* have stirring blades 526*a*, 526*b*, 526*c*, and 526*d* therein. The toner bottles 525*a*, 525*b*, 525*c*, and 525*d* operate the stirring blades 526*a*, 526*b*, 526*c*, and 526*d* to supply toner to the developers 504*a*, 504*b*, 504*c*, and 504*d*.

Furthermore, the imager 501 further includes toner sensors 531*a*, 531*b*, 531*c*, and 531*d* that measure the toner amounts of the developers 504*a*, 504*b*, 504*c*, and 504*d*.

The intermediate transfer belt 502 forms an image by superimposing toner images of four colors formed on the photoconductors 503*a*, 503*b*, 503*c*, and 503*d*. The intermediate transfer belt 502 incorporates primary transfer rollers 534*a*, 534*b*, 534*c*, and 534*d* corresponding to the cartridges 528*a*, 528*b*, 528*c*, and 528*d* of the respective colors.

In addition, an intermediate transfer belt cleaner 507 that separates transfer residual toner from the intermediate transfer belt 502 is provided on the intermediate transfer belt 502. Then, the transfer residual toner separated from the intermediate transfer belt 502 by the intermediate transfer belt cleaner 507 is stored in waste toner BOX 515.

The conveyor 520 that conveys the recording material includes a paper feeding roller 508, a paper feeding sensor 532, a timing roller 510, a secondary transfer roller 511, a static elimination cloth 530, a fixing roller 512, a paper ejection roller 513, and duplex path conveyance rollers 514*a* and 514*b*.

The paper feeding roller 508 feeds the recording material from the paper feeder 18 to the conveyance path. The paper feeding sensor 532 detects that the recording material has been fed from the paper feeder 18. The timing roller 510 temporarily stops the recording material conveyed in accordance with the timing of image formation by the imager 501. The secondary transfer roller 511 transfers the toner image formed on the intermediate transfer belt 502 onto the recording material. The static elimination cloth 530 is provided to perform static elimination on the recording material after the transfer of the toner image.

The fixing roller 512 fixes the transferred toner image on the recording material. The fixing roller 512 includes a heating roller 512*a* and a pressure roller 512*b*.

The paper ejection roller 513 discharges the recording material that has passed through the fixing roller 512 to the paper ejection tray 19 through the paper ejection port 21 or conveys the recording material to a duplex conveyance path 529.

On the duplex conveyance path 529, the duplex path conveyance rollers 514*a* and 514*b* that convey the recording material from the paper ejection roller 513 to the timing roller 510 are disposed.

In the image forming apparatus 100, the conveyor 520 includes a paper ejection sensor, which is not illustrated, at the paper ejection port 21 for the recording material on the downstream side of the paper ejection roller 513. The paper ejection sensor detects the number of recording materials ejected onto the paper ejection tray 19. For example, the number of loaded papers on the paper ejection tray 19 is detected by counting the number of recording materials ejected after the paper ejection sensor is activated (ON). In addition, the paper ejection sensor detects an upper limit of the number of loaded recording materials on the paper ejection tray 19. For example, in a case where the paper ejection sensor is activated in a state where there are 150 sheets of paper on the paper ejection tray and in a case where a predetermined number of (for example, 100) papers is ejected after the activation, the paper ejection sensor detects the upper limit of the loaded recording materials on the paper ejection tray 19.

In addition, the image forming system 10 includes an environment detector 535 in a housing of the image forming apparatus 100. The environment detector 535 detects temperature, humidity, and the like around the conveyed recording material as an operation environment of the image forming system 10.

[Medium Sensor]

The medium sensor 533 is disposed on the downstream side of the paper feeding sensor 532 in the conveyance path of the recording material. The medium sensor 533 acquires a physical property value of the recording material. Note that the disposition of the medium sensor 533 is not particularly limited as long as it is on the conveyance path of the recording material. For example, image forming conditions can be set according to the physical property value detected by the medium sensor 533 by disposing the medium sensor 533 on the upstream side of the imager 501 as illustrated in FIG. 2. In addition, for example, by disposing the medium sensor 533 on the downstream side of the fixing roller 512, the physical property value of the recording material that has been heated and pressurized by the fixing roller 512 can be acquired. On the basis of the physical property value of the recording material acquired by the medium sensor 533, the information processor 23 (FIG. 1) determines the condition (alignment condition and operation parameter) of the alignment processing to be executed by the post-processor 200 in a controller 300 (FIG. 3) to be described below.

The medium sensor 533 detects, for example, the smoothness, the rigidity, and the thickness, which are physical property values unique to the recording material, as the physical property value of the recording material. In addition, the medium sensor 533 detects the charge amount, the water content, and the paper grain (angle of recording material in fiber direction) of the recording material that vary depending on the surrounding environment and usage. The charge amount is generated by friction with the conveyance path due to the influence of the external environment on the recording material. The water content varies depending on the external environment and the fixing processing of the image forming apparatus 100.

The paper grain depends on a method of setting the recording material in the paper feeder 18 by the user. Note that the charge amount and the water content are preferably applied to the image forming system 10 having a configuration in which the medium sensor 533 is disposed on the downstream side of the fixing roller 512. By acquiring the physical property value on the downstream side of the fixing roller 512, the charge amount and the water content of the recording material changed by the fixing processing can be acquired.

The medium sensor 533 preferably detects at least one or more types from the aforementioned physical property values. Note that the medium sensor 533 may acquire a physical property value of the recording material other than those described above. In addition, the configuration of the medium sensor 533 is not particularly limited. As long as the aforementioned physical property value of the recording material can be acquired, a conventionally known detector can be used without particular limitation.

[Block Diagram]

Figure 3:
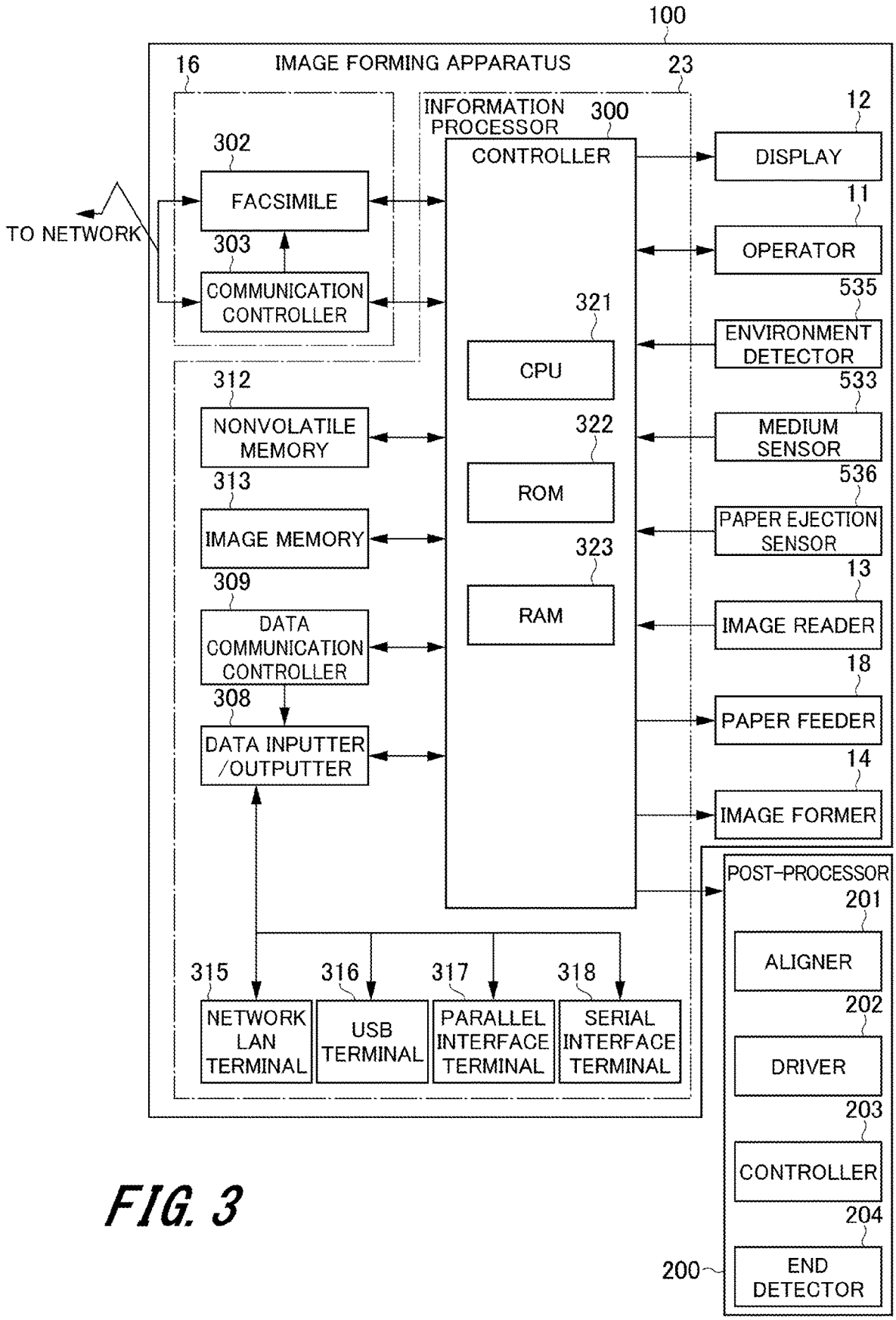
FIG. 3 is a block diagram illustrating a configuration example of an image forming system.

FIG. 3 illustrates a block diagram of a configuration example of the image forming system 10. As illustrated in FIG. 3, the image forming apparatus 100 of the image forming system 10 includes the information processor 23, the communicator 16, the paper feeder 18, the image reader 13, and the image former 14. In addition, the image forming apparatus 100 includes the medium sensor 533, the environment detector 535, and a paper ejection sensor 536.

In the image forming apparatus 100, the information processor 23 includes a data inputter/outputter 308, a data communication controller 309, the controller 300, nonvolatile memory 312, and image memory 313.

The information processor 23 controls deletion, output, and the like of a job stored in the image memory 313.

In addition, the information processor 23 receives a job execution instruction from the user through the operator 11. In addition, the information processor 23 displays a selection menu, information of image data acquired by the image reader 13, and the like through the display 12.

The controller 300 includes a CPU 321, ROM 322, and RAM 323. The CPU 321 integrally controls the entire operation of the image forming apparatus 100 on the basis of information received from each unit in the image forming apparatus 100. Various programs and data are stored in the ROM 322, and the CPU 321 reads programs and data from the ROM 322 and controls the image forming apparatus 100. The RAM 323 temporarily stores programs and data necessary for the CPU 321 to control the image forming apparatus 100.

The nonvolatile memory 312 includes, for example, a hard disk and the like, and stores the image data acquired by the image reader 13, image data acquired from the outside via the network, and the like.

In addition, the nonvolatile memory 312 stores image forming conditions set in an image forming job. For example, the nonvolatile memory 312 stores an image forming condition input by the user via the operator 11 and a condition set in advance for a recording material to be used. The nonvolatile memory 312 stores, for example, conditions such as the basis weight, the size, the type, the printing surface, and the coverage of the recording material as the image forming conditions set for the recording material used in the image forming job.

The controller 300 acquires the image data stored in the nonvolatile memory 312, and performs various processing according to the content of a job received from the user. For example, the controller 300 transmits the image data to the outside using a facsimile 302. In addition, the controller 300 uses the image former 14 to issue an instruction to deliver the recording material to the paper feeder 18 and issue an instruction to the image former 14 to execute the image formation.

The data inputter/outputter 308 and the communicator 16 are connected to the controller 300. The data inputter/outputter 308 is provided with a plurality of interface terminals such as a transmission control protocol (TCP)/Internet protocol (IP)-based network local area network (LAN) terminal 315, a universal serial bus (USB) terminal 316, a parallel interface terminal 317, and a serial interface terminal 318. In the data inputter/outputter 308, in a case where the external equipment is connected to each terminal described above, processing such as reading, writing, and deleting of data from the external equipment is performed by the controller 300.

The communicator 16 includes the facsimile 302 and a communication controller 303, and transmits and receives data to and from the outside of the image forming system 10 via the network.

The medium sensor 533 transmits the acquired physical property value of the recording material to the controller 300 of the information processor 23. On the basis of the physical property value of the recording material acquired by the medium sensor 533, the controller 300 determines the condition (alignment condition and operation parameter) of the alignment processing to be executed by the post-processor 200.

The environment detector 535 detects an operation environment such as temperature and humidity around the area in which the image forming system 10 operates, and transmits the operation environment to the controller 300. The controller 300 may refer to the environmental condition acquired by the environment detector 535 when determining the condition (alignment condition and operation parameter) of the alignment processing to be executed by the post-processor 200.

The paper ejection sensor 536 detects the number of recording materials passing through the paper ejection port 21 of the image forming apparatus 100, and transmits the number of recording materials that have passed through the paper ejection port 21 to the controller 300. The controller 300 may refer to the number of loaded recording materials on the paper ejection tray 19 on the basis of the number of recording materials that have passed through acquired by the paper ejection sensor 536 when determining the condition (alignment condition and operation parameter) of the alignment processing to be executed by the post-processor 200.

The post-processor 200 includes an aligner 201, a driver 202, an end detector (end detection sensor) 204, and a controller 203.

The controller 203 includes a CPU, ROM, and RAM, which are not illustrated. The CPU of the controller 203 reads various processing programs stored in the ROM, loads the programs onto the RAM, and integrally controls the operation of each unit of the post-processor 200 according to the loaded programs.

In addition, the controller 203 of the post-processor 200 controls driving of the image forming system 10 in cooperation with the controller 300 of the image forming apparatus 100 by communicating with each other. For example, the controller 203 may acquire the physical property value of the recording material acquired by the medium sensor 533 from the controller 300 of the image forming apparatus 100. Then, the controller 203 may determine the condition (alignment condition and operation parameter) of the alignment processing to be executed by the post-processor 200 on the basis of the acquired physical property value of the recording material.

The aligner 201 is disposed on the paper ejection tray of the image forming apparatus 100, and moves the recording material to a predetermined position by tapping the end of the recording material loaded on the paper ejection tray to align the recording material. The driver 202 is a drive source for moving the aligner 201 during the alignment processing. By driving the driver 202 by the controller 203, the aligner 201 moves on the paper ejection tray. Then, the driver 202 moves the aligner 201 on the basis of the alignment condition determined by the controller 300 or the controller 203 to perform the alignment processing of the recording material.

The end detector 204 detects the end of the recording material loaded on the paper ejection tray 19. Then, the end detector 204 transmits information of the detected end of the recording material to the controller 203. The end detector 204 detects the positions of an end in an initial state where the recording material is ejected onto the paper ejection tray 19, an end of the recording material during the alignment processing by the aligner 201, and an end of the recording material after the alignment processing. Then, based on the information detected by the end detector 204, the controller 203 detects the alignment state of the recording material on the paper ejection tray 19, which is the recording material loader.

Note that, in the above description, a part or all of the series of processing performed by the controller 300 of the image forming apparatus 100 may be performed by the controller 203 of the post-processor 200. Similarly, a part or all of the series of processing performed by the controller 203 of the post-processor 200 may be performed by the controller 300 of the image forming apparatus 100.

<2. Configurations of the Post-Processor and the Aligner>

Figure 4:
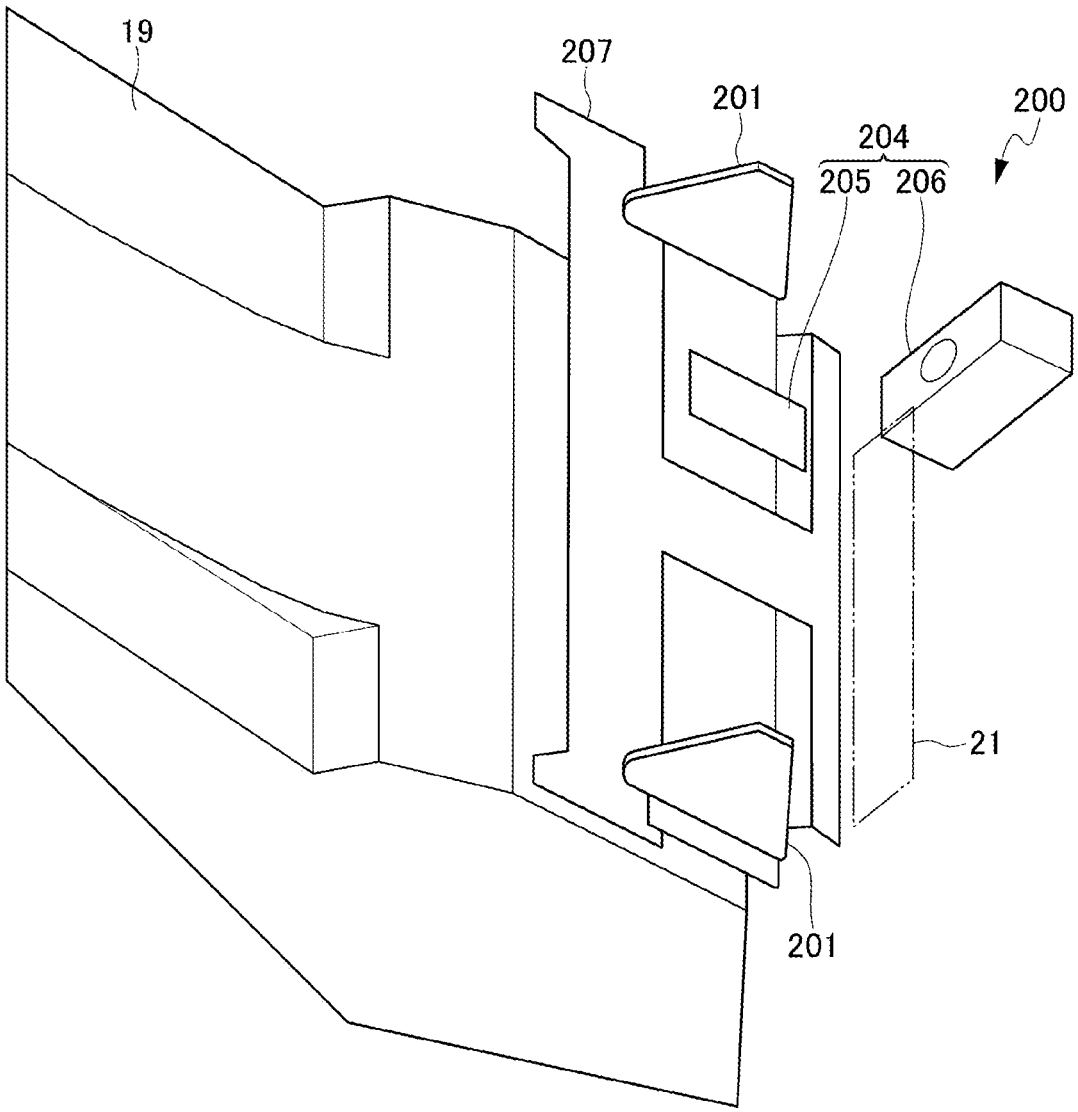
FIG. 4 is a diagram illustrating a configuration of a post-processor provided at a paper ejector of an image forming apparatus.

Next, a configuration of the post-processor 200 of the image forming system 10 will be described. FIG. 4 illustrates a configuration of the post-processor 200 provided at the paper ejector of the image forming apparatus 100. FIG. 4 illustrates a configuration in which the aligner 201 is disposed on the paper ejection tray 19, which is a recording material stacker, as a mounting example of the post-processor 200.

[Configuration of the Post-Processor]

The post-processor 200 is disposed on the paper ejection tray 19 on which the recording material conveyed through the conveyance path of the image forming apparatus 100 is loaded. In addition, the post-processor 200 is disposed on the paper ejection tray 19 on the paper ejection port 21 side of the image forming apparatus 100. Note that the disposition of the post-processor 200 is not particularly limited as long as the recording material can be aligned.

As illustrated in FIG. 4, the post-processor 200 includes the aligner 201 disposed at both ends in a direction (hereinafter, in the width direction) orthogonal to the conveyance direction of the recording material. The aligner 201 moves back and forth in the direction of the center from the end side in the width direction along a recess of a guide plate 207 formed in an H-shaped pattern. Then, as the aligner 201 moves in the width direction, the aligner 201 comes into contact with the end of the recording material that has been ejected through the paper ejection port 21 and loaded on the paper ejection tray 19. Then, by moving the aligner 201 in the width direction in a state of being in contact with the end of the recording material, the recording material is pushed and moved in the direction of the center, and the recording material is aligned to the central portion of the paper ejection tray 19. Note that the configuration illustrated in FIG. 4 indicates the configuration in which the end of the recording material in the width direction is aligned, but the aligner may be disposed at a position where the end of the recording material in the conveyance direction is aligned.

In the post-processor 200, the aligner 201 is moved by the controller 203 (see FIG. 3) and the driver 202 (see FIG. 3), which are not illustrated in FIG. 4. For example, the driving of the driver 202 is controlled by the controller 203, and the movement of the aligner 201 is controlled by the driving of the driver 202.

In addition, the post-processor 200 includes a sensor 205 and a camera 206 as the end detector 204 for detecting the end of the recording material loaded on the paper ejection tray 19. Note that it is sufficient if the post-processor 200 includes one or more end detectors 204.

The sensor 205 is disposed in the recess of the H-shaped pattern of the guide plate 207 on the paper ejection tray 19. The sensor 205 detects the position of the end of the recording material located within the detection range. Note that, although the configuration using one sensor 205 is illustrated in FIG. 4, the sensor 205 may be installed at each of both ends of the paper ejection tray 19 in the width direction, and the interval between the edges detected by the two sensors 205 may be measured.

The camera 206 is disposed in the housing of the image forming apparatus 100 and is disposed in the vicinity of the paper ejection port 21. The camera 206 captures an image of the end of the recording material loaded on the paper ejection tray 19 from the paper ejection port 21 side.

[Description of the Alignment Processing Operation]

Next, an operation in which the aligner 201 aligns the recording material in the post-processor 200 will be described. FIGS. 5 to 8 illustrate an operation of the aligner 201 for each stage of the alignment processing.

Figure 5:
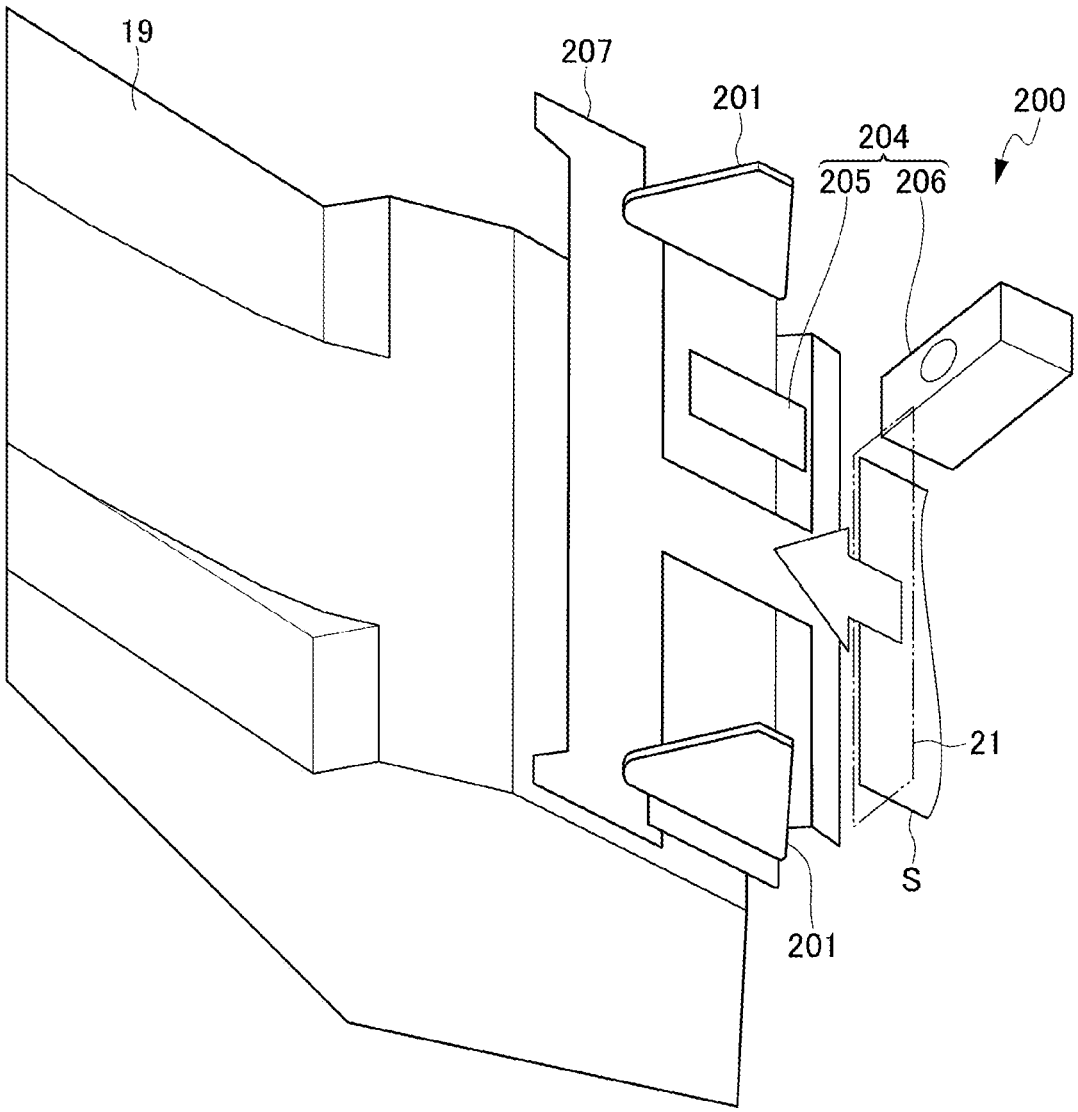
FIG. 5 is a diagram illustrating an operation of an aligner for each stage of alignment processing.

First, as illustrated in FIG. 5, a recording material S is ejected through the paper ejection port 21 of the image forming apparatus 100. At this time, the post-processor 200 drives the driver 202 in advance, and causes the aligners 201 to stand by in a state of being opened to both end sides in the width direction.

Figure 6:
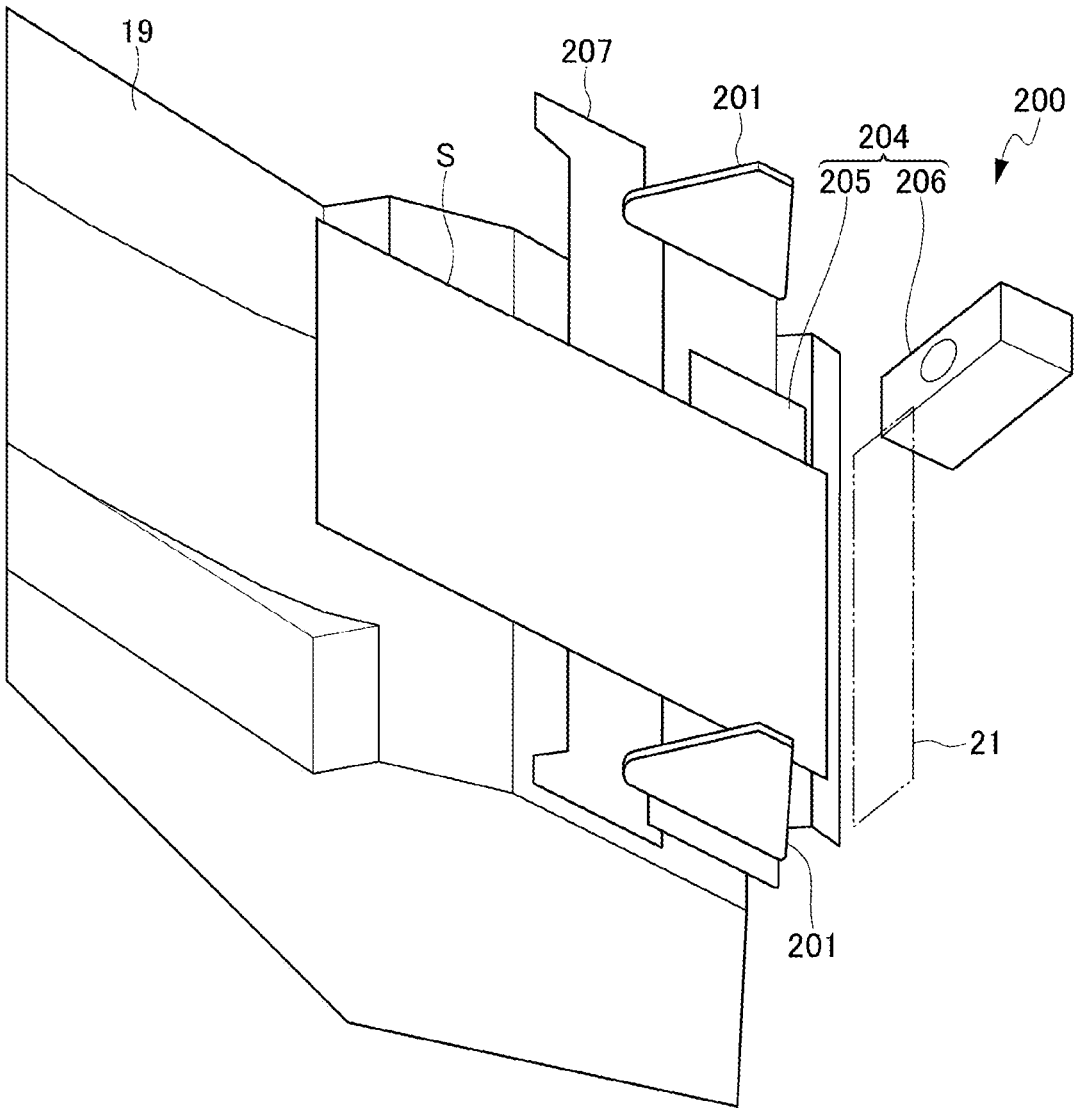
FIG. 6 is a diagram illustrating an operation of an aligner for each stage of alignment processing.

Next, as illustrated in FIG. 6, the recording material S is fully discharged through the paper ejection port 21 of the image forming apparatus 100, and the recording material S is loaded on the paper ejection tray 19. The post-processor 200 detects the position information of the end of the recording material S on the paper ejection tray 19 before the alignment processing by detecting the end of the recording material S on the paper ejection tray 19 by the end detector 204.

Figure 7:
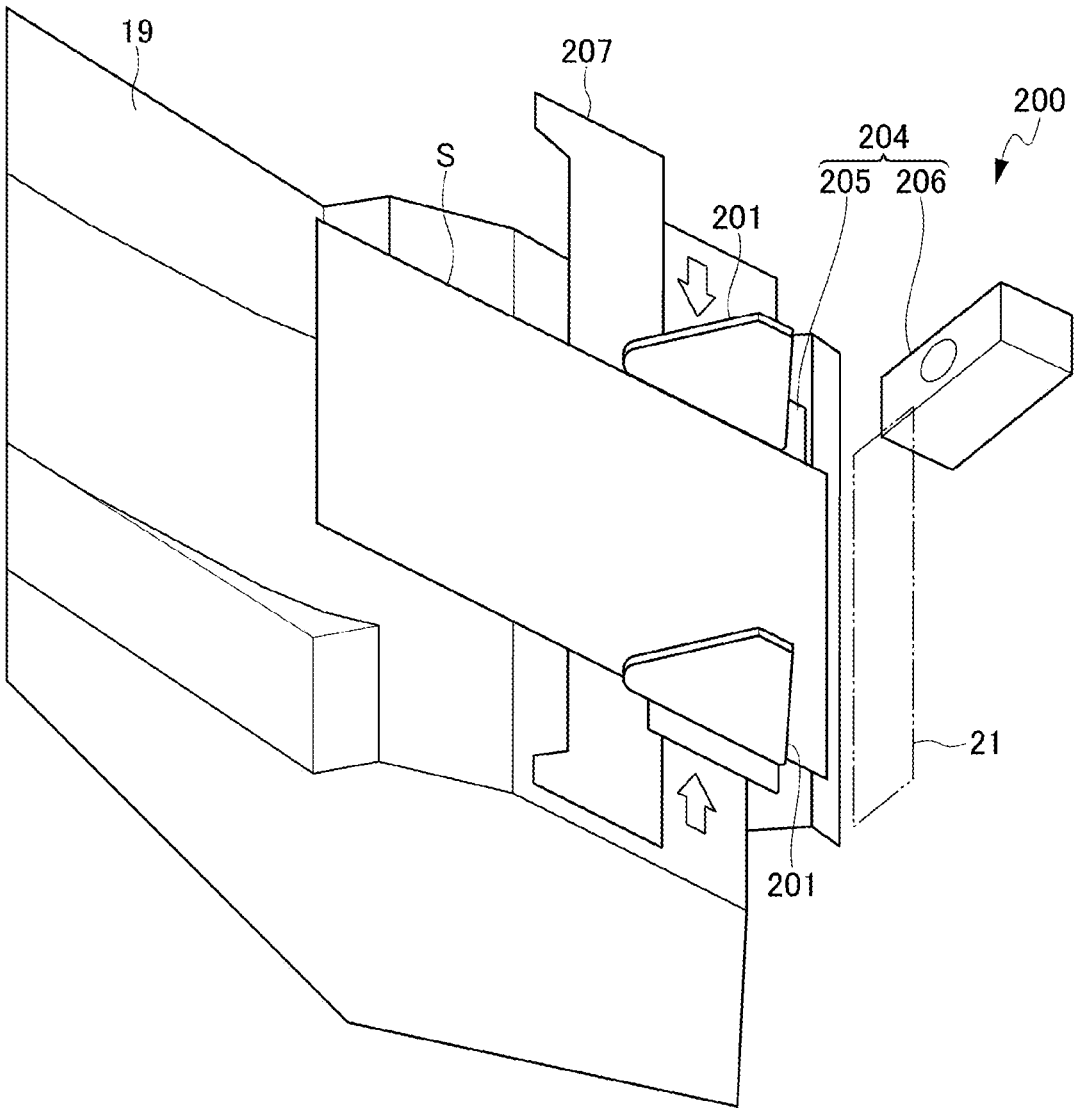
FIG. 7 is a diagram illustrating an operation of an aligner for each stage of alignment processing.

Next, as illustrated in FIG. 7, the post-processor 200 drives the driver 202 to move the aligners 201 to the central portion in accordance with the width of the recording material S to perform the alignment processing of the recording material S. The post-processor 200 executes the alignment processing in accordance with the operation parameter of the alignment processing determined by the controller 300 and the controller 203.

The end detector 204 detects the end of the recording material S on the paper ejection tray 19 after the movement of the aligners 201, and detects the position information of the end of the recording material S on the paper ejection tray 19. For example, the position information of the end of the recording material S on the paper ejection tray 19 after the alignment processing is detected. In addition, in a case where the alignment processing is performed by moving the aligners 201 back and forth a plurality of times, the position information of the end of the recording material S during the alignment processing may be detected.

Figure 8:
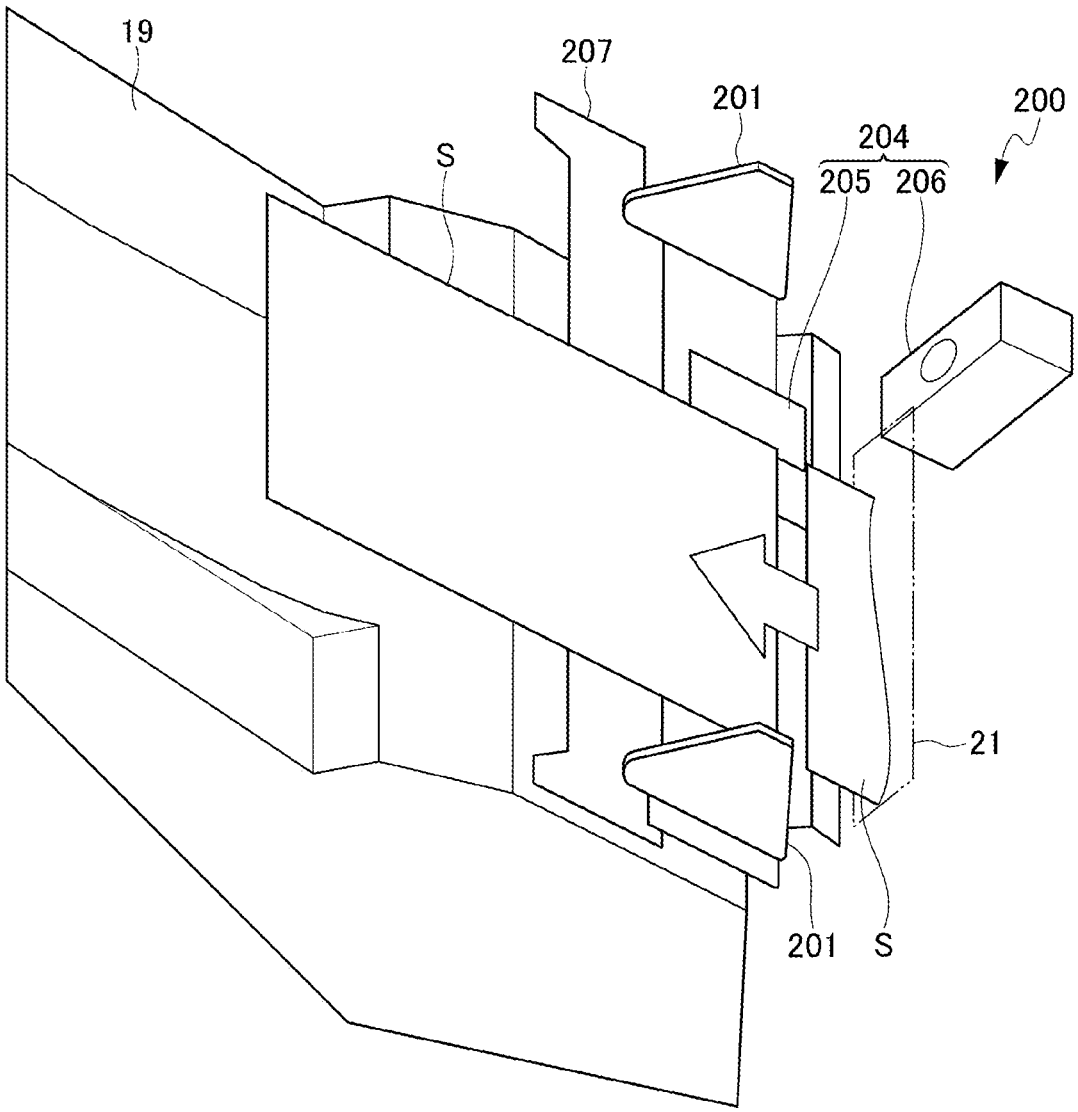
FIG. 8 is a diagram illustrating an operation of an aligner for each stage of alignment processing.

Next, as illustrated in FIG. 8, after the alignment processing of the recording material S by the aligners 201 is completed, a next recording material S is ejected through the paper ejection port 21. Then, after the recording material S is fully ejected onto the paper ejection tray 19, the post-processor 200 repeats the above-described processing of FIGS. 5 to 7 and the recording materials can be aligned. Note that as illustrated in FIGS. 5 to 8 described above, the alignment processing by the post-processor 200 may be performed every time the recording materials S are ejected one by one, or may be performed in a state where a plurality of recording materials S is loaded every time a predetermined number of papers is ejected onto the paper ejection tray 19.

[Configuration of the Controller]

A functional configuration of the controller 203 of the post-processor 200 that controls driving of the aligners 201 in the post-processor 200 described above will be described. Note that the driving control of the aligners 201 may be performed by either the controller 300 of the image forming apparatus 100 or the controller 203 of the post-processor 200. In the following description, an example in which the controller 203 of the post-processor 200 performs the driving control of the aligners 201 will be described. The controller 300 of the image forming apparatus 100 can also perform the driving control of the aligners 201 with a similar configuration in cooperation with the controller 203 of the post-processor 200 by communicating with each other.

Figure 9:
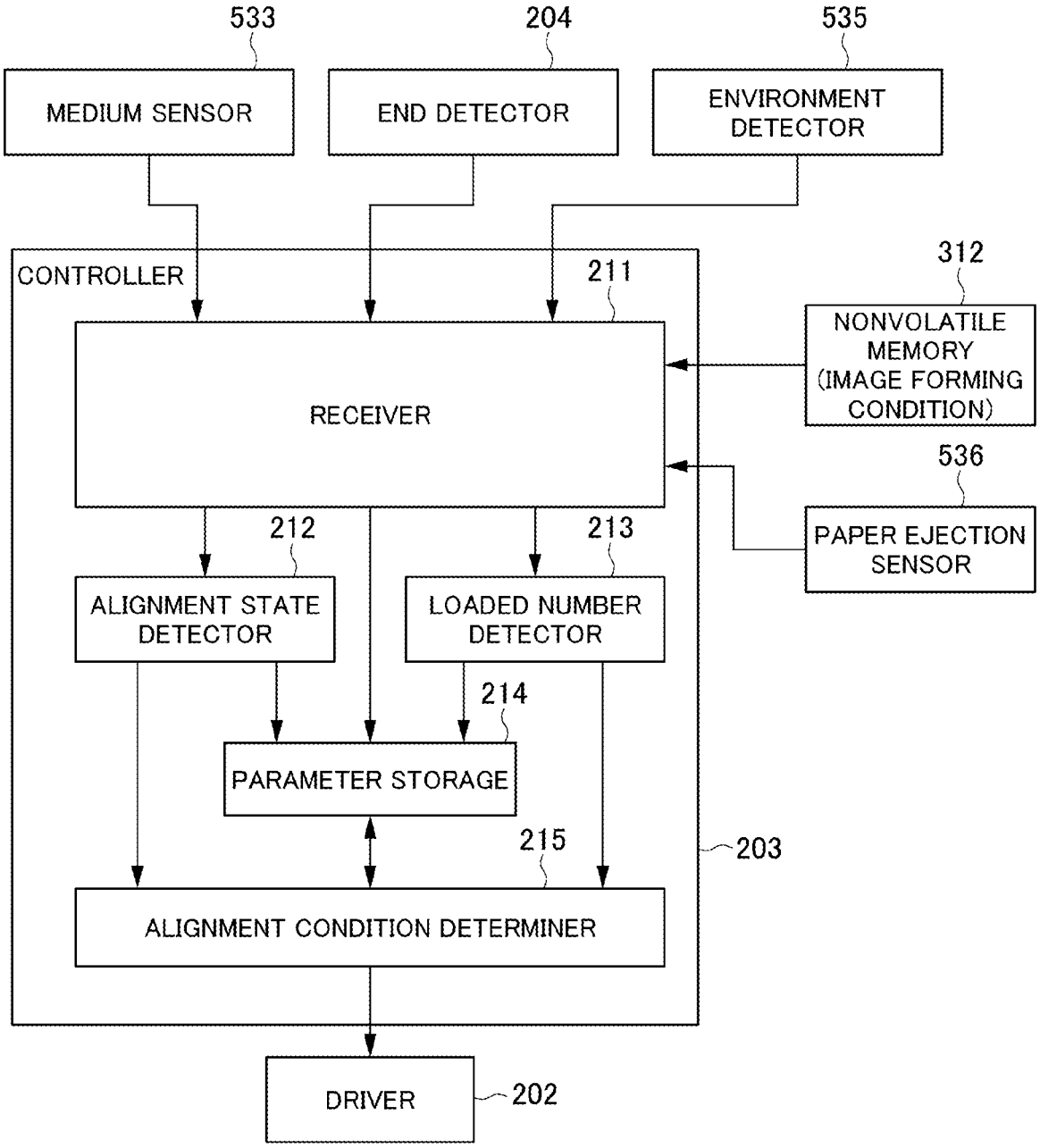
FIG. 9 is a functional block diagram of a controller of an image forming system.

FIG. 9 illustrates a functional block diagram of the controller 203. The controller 203 includes a receiver 211, an alignment state detector 212, a loaded paper number detector 213, a parameter storage 214, and an alignment condition determiner 215.

The receiver 211 receives the physical property value of the recording material acquired by the medium sensor 533. For example, the receiver 211 receives at least one or more physical property values selected from the smoothness, the rigidity, the thickness, the charge amount, the water content, and the paper grain from the medium sensor 533.

In addition, the receiver 211 acquires information from at least one or more selected from the end detector 204, the environment detector 535, the nonvolatile memory 312, and the paper ejection sensor 536.

The receiver 211 acquires the information of the end of the recording material loaded on the paper ejection tray 19 detected by the end detector 204. For example, the receiver 211 acquires the information of the end of the recording material at least once or more in any of states: before the alignment processing, in the middle of the alignment processing, and after the alignment processing.

The receiver 211 acquires the environmental condition for performing the alignment processing from the environment detector 535. For example, the receiver 211 acquires temperature and humidity as environmental conditions of the image forming apparatus 100 from the environment detector 535.

The receiver 211 acquires an image forming condition from the nonvolatile memory 312. For example, the receiver 211 acquires at least one or more image forming conditions such as the basis weight, the size, the type, the printing surface, and the coverage stored in the nonvolatile memory 312.

The receiver 211 acquires information indicating that the recording material passes through the paper ejection port 21 from the paper ejection sensor 536. Then, the number of loaded recording materials on the paper ejection tray 19 is acquired on the basis of the number of papers passing through the paper ejection port 21.

The alignment state detector 212 detects the alignment state of the loaded recording material on the basis of the information of the end of the recording material loaded on the paper ejection tray 19 received by the receiver 211 from the end detector 204.

For example, the alignment state detector 212 detects the alignment state of the recording material by determining the degree of variation (alignment degree) in the end position of the recording material, determining whether alignment after the alignment processing is successful (alignment result), and the like from the acquired end information of the recording material. In addition, the alignment state detector 212 detects the alignment state of the recording material from the end position of the recording material detected by the sensor 205, which is the end detector 204, and the center value of the paper ejection position. In addition, the alignment state detector 212 measures the position of the end of the recording material on the paper ejection tray 19 and the unevenness of the end of the recording material from the result of imaging by the camera 206 to detect the alignment state of the recording material.

The alignment state detector 212 detects the alignment state of the recording material at least once or more selected from before alignment, during alignment, and after alignment as necessary.

The loaded paper number detector 213 detects the number of loaded recording materials on the paper ejection tray 19 on the basis of the information of the recording material passing through the paper ejection port 21 acquired by the receiver 211 from the paper ejection sensor 536. For example, the loaded paper number detector 213 receives the number of ejected papers from the paper ejection sensor 536 as the passage information of the recording material, and detects the number of loaded recording materials on the paper ejection tray 19.

The parameter storage 214 stores the various conditions acquired and determined when the alignment processing is performed as an alignment history. For example, the parameter storage 214 stores, as input conditions, various types of information such as the physical property value of the recording material, the end information, the environmental condition, and the image forming condition acquired by the receiver 211, the alignment state detected by the alignment state detector 212, and the number of loaded papers detected by the loaded paper number detector 213. Furthermore, the parameter storage 214 stores the operation parameter (alignment condition) determined by the alignment condition determiner 215 in accordance with various input conditions. In addition, after performing the alignment processing using the operation parameter determined by the alignment condition determiner 215, the parameter storage 214 stores success or failure of alignment after the alignment processing determined by the alignment state detector 212 as an alignment result.

FIG. 10 illustrates an example of the data table of the alignment history including various input conditions, operation parameters corresponding to the input conditions, and the determination of the alignment result stored in the parameter storage 214. In the example illustrated in FIG. 10, as input conditions, the smoothness, the charge amount, the rigidity, the water content, and the paper grain, which are physical property values of the recording material, the basis weight, the size, the type, the printing surface, and the coverage, which are image forming conditions, and the number of loaded papers detected by the loaded paper number detector 213 are registered in the data table.

Then, the number of times of movement, the amount of movement, the moving speed, and the drive torque, which are the operation parameters determined as the alignment condition by the alignment condition determiner 215, are registered in the data table in accordance with the input conditions.

Furthermore, as the determination result of the alignment processing performed with the determined operation parameter, "1" is registered in the data table when it is determined that the alignment has been correctly performed and "2" is registered when it is determined that the alignment has not been correctly performed.

Note that the data table of the alignment history stored in the parameter storage 214 may be stored not in the image forming apparatus 100 but in, for example, a server or the like connected via the network. In this case, it is sufficient if the parameter storage 214 is provided as a communicable configuration when the controller 203 acquires information for determining the alignment condition.

(Determination of the Alignment Condition)

The alignment condition determiner 215 determines the alignment condition (operation parameter) of the alignment processing to be executed by the post-processor 200 on the basis of at least one or more conditions of the smoothness, the charge amount, the rigidity, the water content, and the paper grain, which are the physical property values of the recording material described above.

In addition, the alignment condition determiner 215 may refer to at least one or more conditions of the basis weight, the size, the type, the printing surface, the coverage, the number of loaded papers, and the environmental condition in determining the alignment condition. The basis weight has an influence as the weight of the recording material at the time of alignment. The recording material size has an influence on the range of movement of an alignment plate. The recording material type, the printing surface, and the coverage have an influence on the friction coefficient between the recording materials.

The alignment condition determiner 215 determines at least one or more alignment conditions selected from the number of times of movement, the amount of movement, and the moving speed of the aligner 201, and the drive torque of the driver 202. In the alignment condition determined by the alignment condition determiner 215, the moving speed is a force for aligning the recording material, but when the force is too strong, the recording material is likely to be damaged, and when the force is weak, the alignment becomes difficult. When the drive torque is weak with respect to the weight of the recording material to be aligned, the alignment becomes difficult. The smaller the number of times of movement of the aligner 201, the higher the productivity.

The alignment condition determiner 215 may determine the operation parameter that meets the input condition with reference to the alignment history registered in the parameter storage 214. For example, the alignment condition determiner 215 extracts samples with output parameters the alignment results of which are "1" from samples approximate to the input condition of the recording material on which the alignment processing is executed in the data table of the alignment history registered in the parameter storage 214. Then, the alignment condition determiner 215 analyzes the output parameters of the extracted samples and determines the center value of all the output parameters as the alignment condition.

The alignment condition determiner 215 outputs the determined alignment condition to the driver 202. The driver 202 moves the aligners 201 according to the alignment condition to perform the alignment processing. The alignment condition determined by the alignment condition determiner 215 is stored in the parameter storage 214, and is registered in the data table as an alignment history together with the input condition and the alignment result.

In addition, the alignment condition determiner 215 acquires the alignment states before the alignment processing, in the middle of the alignment processing, and after the alignment processing from the alignment state detector 212, and collects the alignment states of the recording material from the start to the end of the alignment processing in time series. Accordingly, the alignment condition determiner 215 can determine a more detailed operation parameter of the aligners 201. For example, when the number of times of movement is a plurality of times under the alignment condition determined by the alignment condition determiner 215, the alignment condition determiner 215 acquires the alignment state while the aligners 201 tap the recording material a plurality of times. Then, the alignment condition determiner 215 newly determines an operation parameter on the basis of the acquired alignment state in the middle of the alignment processing. By determining the new operation parameter, the alignment condition determiner 215 can determine a more detailed operation parameter as an alignment condition with high alignment degree.

In addition, the alignment condition determiner 215 may use statistics or machine learning as a method of determining the operation parameter. For example, the alignment condition determiner 215 can determine the operation parameter as an output when the information of the physical property value is input by using a learned model obtained by performing machine learning based on the information of the physical property value and the executed operation parameter stored in the parameter storage 214. In addition, the alignment condition determiner 215 can determine the operation parameter as an output when the information of the physical property value and at least one or more pieces of information selected from the alignment state of the recording material, the image forming condition, the number of recording materials, and the operation environment are input using a learned model obtained by performing machine learning based on at least one or more pieces of information selected from the alignment state of the recording material, the image forming condition, the number of recording materials, and the operation environment and the executed operation parameter stored in the parameter storage in addition to the information of the physical property value.

As the machine learning used by the alignment condition determiner 215, for example, analysis of variance for analyzing the influence on the alignment processing operation for each input condition can be used. In addition, it is also possible to calculate an operation parameter with which the alignment has been correctly performed as an objective variable with the input condition as an explanatory variable. In addition, the aforementioned learned model can be updated or generated and used from such input conditions and calculated operation parameter.

[Method of Performing the Alignment Processing (1)]

Figure 11:
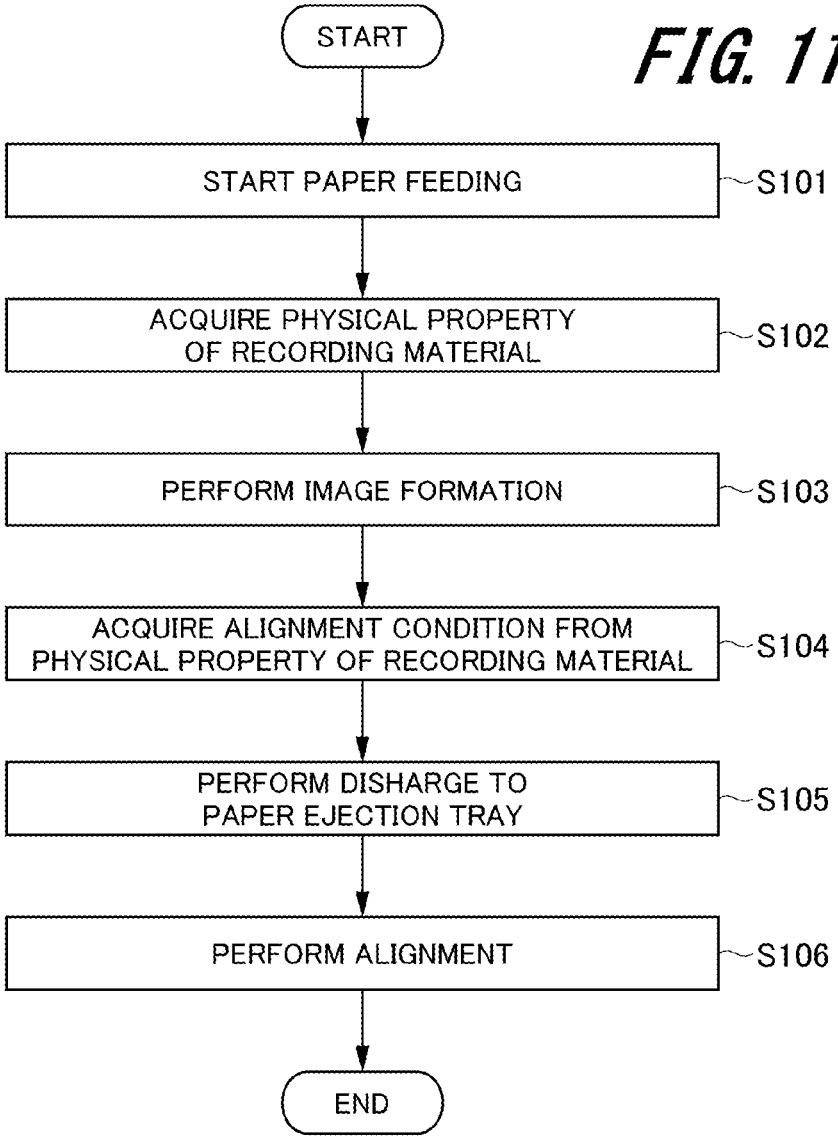
FIG. 11 is a flowchart of alignment processing for determining an alignment condition on the basis of a physical property value of a recording material.

Next, a method of performing the alignment processing in the post-processor 200 will be described. FIG. 11 illustrates a flowchart of the alignment processing. In the flowchart illustrated in FIG. 11, an example in which the alignment condition is determined on the basis of the physical property value of the recording material and the alignment processing is executed will be described. Note that, in the following description, the description overlapping with the description of each configuration of the image forming system 10 described above will be omitted. In addition, in the following description, an example in which the alignment processing is performed using the controller 300 of the image forming apparatus 100 will be described, but the alignment processing can be similarly performed using the controller 203 of the post-processor 200 instead of the controller 300.

First, in response to the instruction to start the image forming job, the controller 300 of the image forming apparatus 100 starts feeding the recording material from the paper feeder 18 (step S101).

Next, the medium sensor 533 acquires the physical property value with respect to the recording material being conveyed (step S102). After acquiring the physical property value of the recording material, the medium sensor 533 outputs the acquired physical property value to the controller 300.

Next, the image former 14 of the image forming apparatus 100 transfers and fixes a toner image to the conveyed recording material to perform image formation (step S103).

Next, in the controller 300, the alignment condition determiner 215 determines the alignment condition (operation parameter) on the basis of the physical property value of the recording material acquired by the receiver 211 (step S104).

Next, the image forming apparatus 100 ejects the recording material after the image formation onto the paper ejection tray 19 (step S105).

After the recording material is loaded on the paper ejection tray 19, the post-processor 200 outputs the alignment condition determined by the controller 300 to the post-processor 200 to drive the driver 202, and moves the aligners 201 to perform the alignment processing of the recording material loaded on the paper ejection tray 19 (step S106).

After the processing of step S106, the processing according to this flowchart ends.

By the above-described processing, the controller 300 determines the alignment condition on the basis of the physical property value of the recording material acquired by the medium sensor 533, and the alignment processing with high accuracy in accordance with the physical property of the recording material can be performed.

Note that, in the image forming system 10, in a case where the medium sensor 533 is disposed on the downstream side of the image former 14, the acquisition of the physical property of the recording material in step S102 may be performed after the image formation in step S104 is performed.

[Method of Performing the Alignment Processing (2)]

Figure 12:
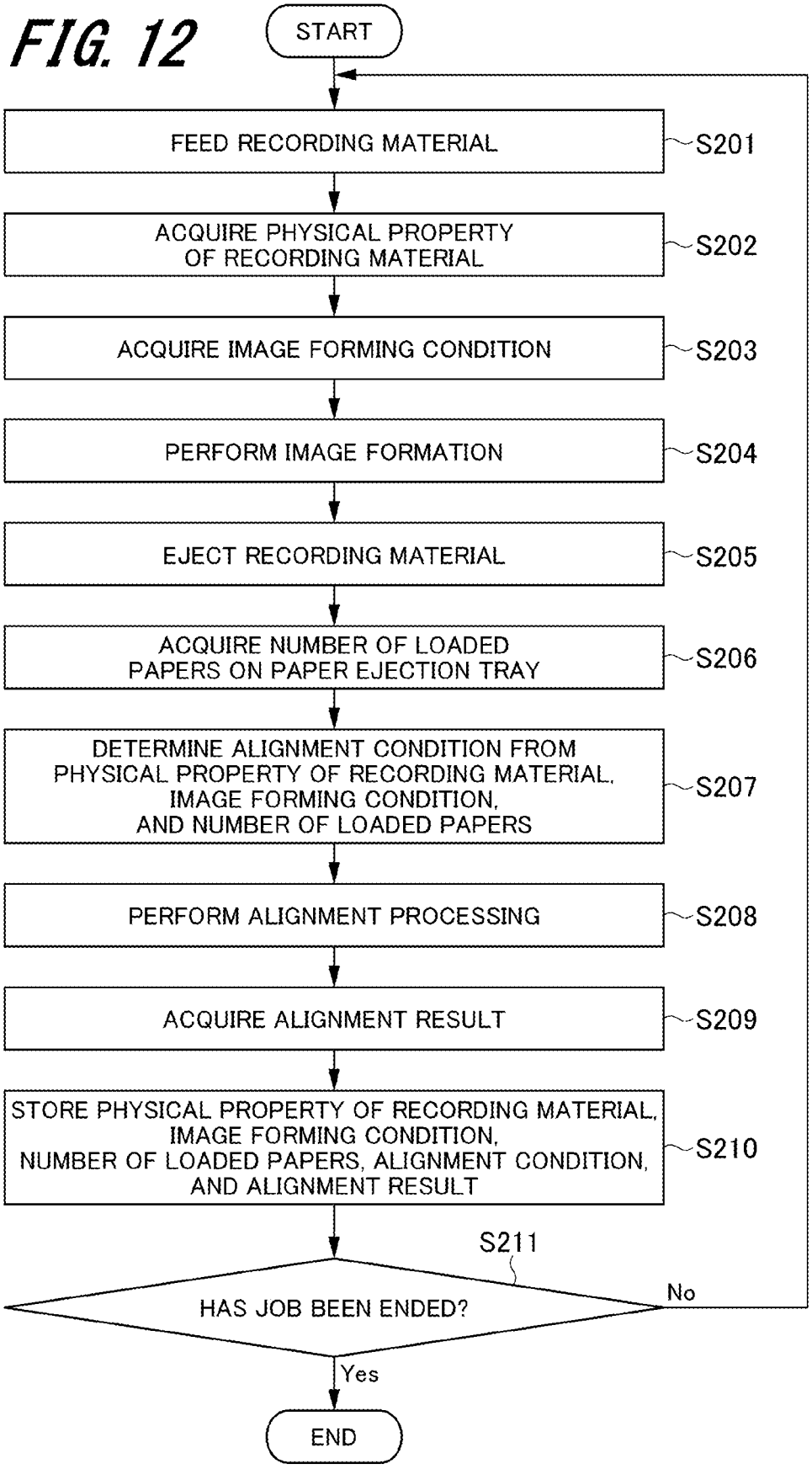
FIG. 12 is a flowchart of alignment processing for determining an alignment condition on the basis of other conditions in addition to a physical property value of a recording material.

Next, as a method of performing the alignment processing in the post-processor 200, an example of determining the alignment condition using a condition other than the physical property value in addition to the physical property value of the recording material will be described. FIG. 12 illustrates a flowchart of the alignment processing. Note that, in the following description, an example in which the alignment processing is performed using the controller 300 of the image forming apparatus 100 will be described, but the alignment processing can be similarly performed using the controller 203 of the post-processor 200 instead of the controller 300.

First, in response to the instruction to start the image forming job, the image forming apparatus 100 starts feeding the recording material from the paper feeder 18 (step S201).

Next, the medium sensor 533 acquires the physical property value with respect to the recording material being conveyed (step S202). After acquiring the physical property value of the recording material, the medium sensor 533 outputs the acquired physical property value to the controller 300.

Next, in the controller 300, the receiver 211 acquires the image forming condition set in the job from the nonvolatile memory 312 (step S203).

Next, the image former 14 of the image forming apparatus 100 transfers and fixes a toner image to the conveyed recording material to perform image formation (step S204). Then, the recording material on which the image is formed is ejected to the paper ejection tray 19 (step S205).

Next, the controller 300 acquires the number of recording materials loaded on the paper ejection tray 19 in the loaded paper number detector 213 (step S206). For example, the loaded paper number detector 213 detects the number of loaded recording materials on the paper ejection tray 19 on the basis of the number of ejected papers detected by the paper ejection sensor 536.

Next, in the controller 300, the alignment condition determiner 215 determines the alignment condition (operation parameter) based on the physical property value of the recording material and the image forming condition acquired by the receiver 211, and the number of recording materials loaded on the paper ejection tray 19 (step S207).

Next, the post-processor 200 outputs the alignment condition determined by the controller 300 to the post-processor 200 to drive the driver 202, and moves the aligners 201 to perform the alignment processing of the recording material loaded on the paper ejection tray 19 (step S208).

Next, the controller 300 detects the alignment state of the recording material after the alignment processing, and acquires success or failure of the alignment result (step S209). The alignment state detector 212 acquires the information of the end of the recording material loaded on the paper ejection tray 19 from the end detector 204 and determines whether the alignment result is successful.

Next, the controller 300 stores the alignment condition determined in the alignment processing performed, the input condition of the physical property value of the recording material, the image forming condition, and the number of loaded papers, which are the basis of the determination of the alignment condition, and the determination of the alignment result after the alignment processing in the data table of the parameter storage 214 as an alignment history (step S210).

Next, the controller 300 determines whether all the image formation processing set in the job has been ended (step S211). When the image formation set in the job has not been ended (No in step S211), the processing returns to step S201. When all the jobs have been ended (Yes in step S211), the processing according to this flowchart ends.

By the above-described processing, the controller 300 can determine the alignment condition based on not only the physical property value of the recording material acquired by the medium sensor 533 but also a plurality of conditions such as the image forming condition and the number of loaded papers. Therefore, it is possible to perform the alignment processing with high accuracy using the alignment condition that matches not only the physical property of the recording material but also the other state of the recording material.

Furthermore, in the above-described processing, the alignment condition of the performed alignment processing is stored, and the input condition (physical property value, image forming condition, number of loaded papers) for determining the alignment condition and the success or failure of the alignment result after the alignment processing are stored in the data table as the alignment history. Accordingly, the alignment condition determiner 215 can determine the alignment condition with reference to the alignment history stored in the data table. In addition, the alignment condition determiner 215 can determine the alignment condition by machine learning using the information stored in the data table. Therefore, in the above-described processing, the alignment processing with higher accuracy can be performed.

[Method of Performing the Alignment Processing (3)]

Figure 13:
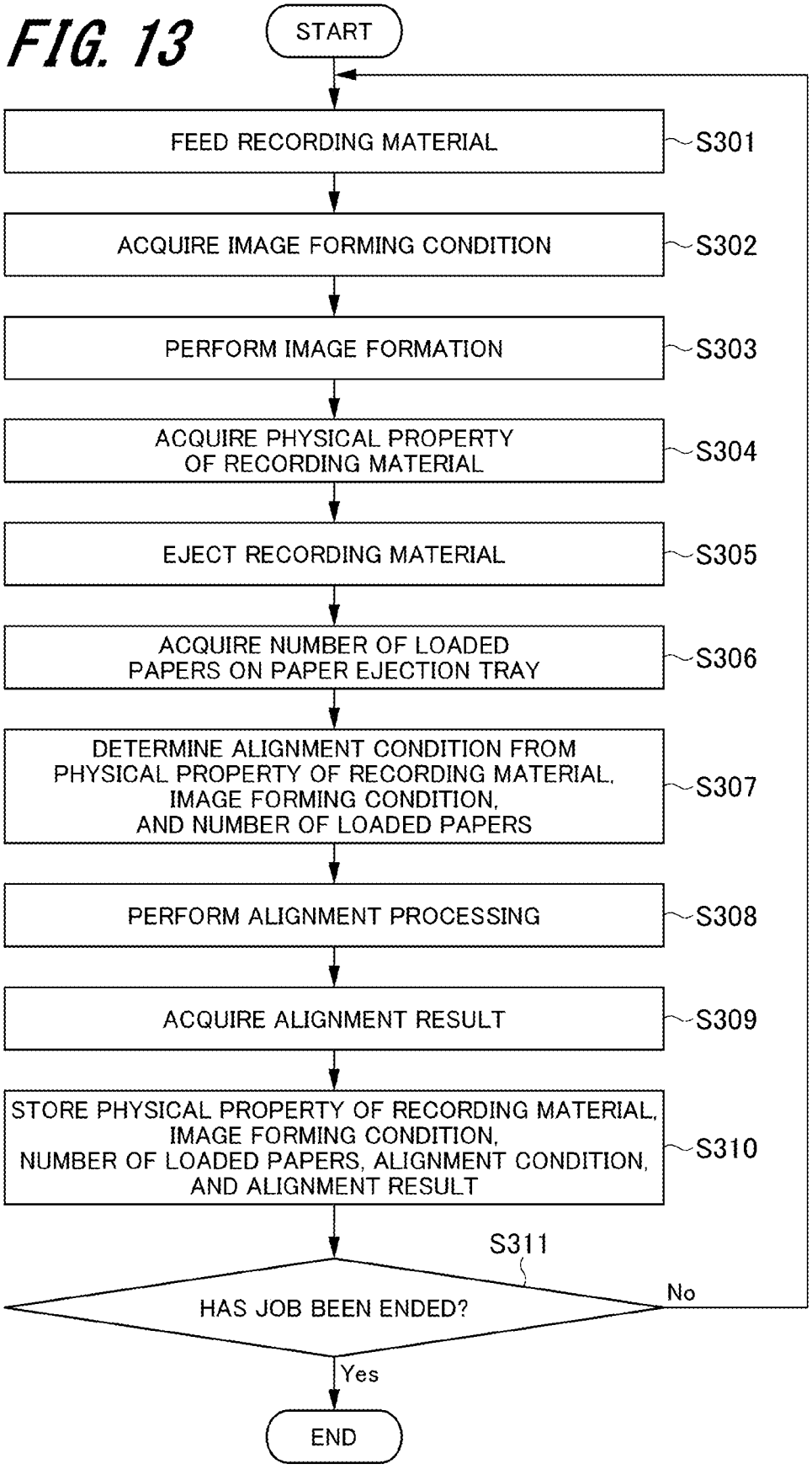
FIG. 13 is a flowchart of alignment processing for detecting a physical property value of a recording material and determining an alignment condition after image formation.

Next, as a method of performing the alignment processing in the post-processor 200, an example of acquiring the physical property value of the recording material after the image formation and determining the alignment condition using a condition other than the physical property value will be described. FIG. 13 illustrates a flowchart of the alignment processing. This processing can be applied to the image forming system 10 having a configuration in which the medium sensor 533 is disposed on the downstream side of the image former 14. Note that, in the following description, an example in which the alignment processing is performed using the controller 300 of the image forming apparatus 100 will be described, but the alignment processing can be similarly performed using the controller 203 of the post-processor 200 instead of the controller 300.

First, in response to the instruction to start the image forming job, the controller 300 of the image forming apparatus 100 starts feeding the recording material from the paper feeder 18 (step S301).

Next, in the controller 300, the receiver 211 acquires the image forming condition set in the job from the nonvolatile memory 312 (step S302).

Then, the image former 14 of the image forming apparatus 100 transfers and fixes a toner image to the conveyed recording material to perform image formation (step S303).

Next, the medium sensor 533 acquires the physical property value of the recording material that has passed through the fixing roller 512 and is being conveyed (step S304). After acquiring the physical property value of the recording material, the medium sensor 533 outputs the acquired physical property value to the controller 300.

After the physical property value is acquired, the recording material on which the image is formed is ejected to the paper ejection tray 19 (step S305).

Next, the controller 300 acquires the number of recording materials loaded on the paper ejection tray 19 in the loaded paper number detector 213 (step S306). For example, the loaded paper number detector 213 detects the number of loaded recording materials on the paper ejection tray 19 on the basis of the number of ejected papers detected by the paper ejection sensor 536.

Next, in the controller 300, the alignment condition determiner 215 determines the alignment condition (operation parameter) based on the physical property value of the recording material that has passed through the fixing roller 512 and the image forming condition acquired by the receiver 211, and the number of recording materials loaded on the paper ejection tray 19 (step S307).

Next, the post-processor 200 outputs the alignment condition determined by the controller 300 to the post-processor 200 to drive the driver 202, and moves the aligners 201 to perform the alignment processing of the recording material loaded on the paper ejection tray 19 (step S308).

Next, the controller 300 detects the alignment state of the recording material after the alignment processing, and acquires success or failure of the alignment result (step S309). The alignment state detector 212 acquires the information of the end of the recording material loaded on the paper ejection tray 19 from the end detector 204 and determines whether the alignment result is successful.

Next, the controller 300 stores the alignment condition determined in the alignment processing performed, the input condition of the physical property value of the recording material that has passed through the fixing roller 512, the image forming condition, and the number of loaded papers, which are the basis of the determination of the alignment condition, and the determination of the alignment result after the alignment processing in the data table of the parameter storage 214 as an alignment history (step S310).

Next, the controller 300 determines whether all the image formation processing set in the job has been ended (step S311). When the image formation set in the job has not been ended (No in step S311), the processing returns to step S301. When all the jobs have been ended (Yes in step S311), the processing according to this flowchart ends.

In the above-described processing, the physical property value of the recording material that has passed through the fixing roller 512 is acquired by the medium sensor 533, and the physical property value of the recording material changed by the image formation from the time of paper feeding can be acquired. In particular, the physical property value of the recording material changed by heating and pressurization by the fixing roller 512 can be acquired. Therefore, as compared with the case where the physical property value of the recording material is acquired upstream of the image former 14, a more accurate physical property value of the recording material loaded on the paper ejection tray 19 can be acquired. As a result, in the above-described processing, the alignment processing with higher accuracy can be performed.

[Method of Performing the Alignment Processing (4)]

Figure 14:
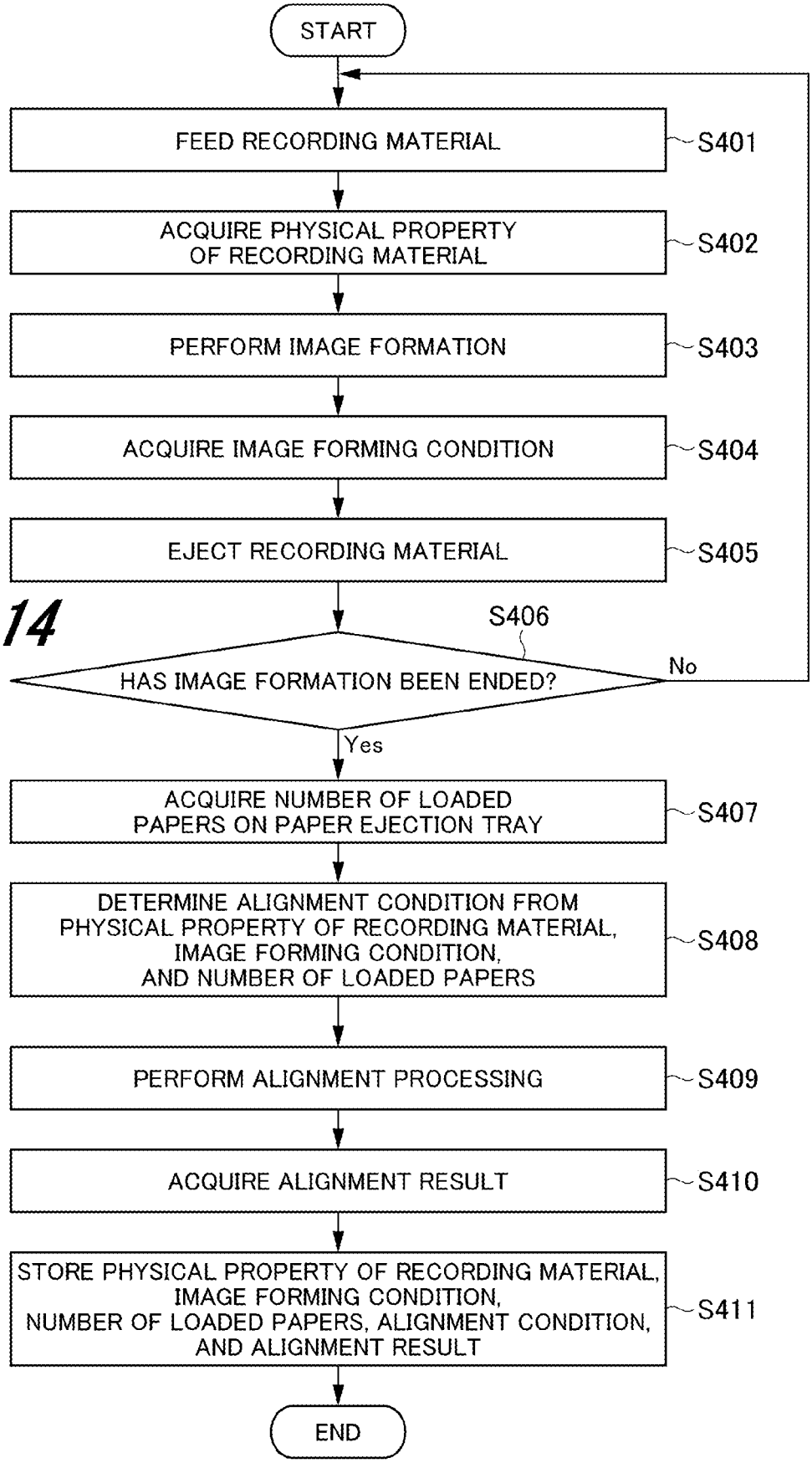
FIG. 14 is a flowchart of alignment processing for determining an alignment condition for each job on the basis of a physical property value of a recording material.

Next, as a method of performing the alignment processing in the post-processor 200, an example of determining the alignment condition for each job and performing the alignment processing will be described. FIG. 14 illustrates a flowchart of the alignment processing. Note that, in the following description, an example in which the alignment processing is performed using the controller 300 of the image forming apparatus 100 will be described, but the alignment processing can be similarly performed using the controller 203 of the post-processor 200 instead of the controller 300.

First, in response to the instruction to start the image forming job, the image forming apparatus 100 starts feeding the recording material from the paper feeder 18 (step S401).

Next, the medium sensor 533 acquires the physical property value with respect to the recording material being conveyed (step S402). After acquiring the physical property value of the recording material, the medium sensor 533 outputs the acquired physical property value to the controller 300.

Next, the image former 14 of the image forming apparatus 100 transfers and fixes a toner image to the conveyed recording material to perform image formation (step S403).

Next, after performing the image formation, in the controller 300, the receiver 211 acquires the image forming condition set in the job from the nonvolatile memory 312 (step S404).

Then, the recording material on which the image is formed is ejected to the paper ejection tray 19 (step S405).

Next, the controller 300 determines whether all the image formation processing set in the job has been ended (step S406). When the image formation set in the job has not been ended (No in step S406), the processing returns to step S401.

When all the image formation set in the job is ended (Yes in step S406), the controller 300 acquires the number of recording materials loaded on the paper ejection tray 19 in the loaded paper number detector 213 (step S407). For example, the loaded paper number detector 213 detects the number of loaded recording materials on the paper ejection tray 19 on the basis of the number of ejected papers detected by the paper ejection sensor 536.

Next, in the controller 300, the alignment condition determiner 215 determines the alignment condition (operation parameter) based on the physical property value of the recording material that has passed through the fixing roller 512 and the image forming condition acquired by the receiver 211, and the number of recording materials loaded on the paper ejection tray 19 (step S408).

Next, the post-processor 200 outputs the alignment condition determined by the controller 300 to the post-processor 200 to drive the driver 202, and moves the aligners 201 to perform the alignment processing of the recording material loaded on the paper ejection tray 19 (step S409).

Next, the controller 300 detects the alignment state of the recording material after the alignment processing, and acquires success or failure of the alignment result (step S410). The alignment state detector 212 acquires the information of the end of the recording material loaded on the paper ejection tray 19 from the end detector 204 and determines whether the alignment result is successful.

Next, the controller 300 stores the alignment condition determined in the alignment processing performed, the input condition of the physical property value of the recording material that has passed through the fixing roller 512, the image forming condition, and the number of loaded papers, which are the basis of the determination of the alignment condition, and the determination of the alignment result after the alignment processing in the data table of the parameter storage 214 as an alignment history (step S411).

After the processing of step S411, the processing according to this flowchart ends.

In the above-described processing, the determination of the alignment condition, the alignment processing, and the processing of storing the alignment history are performed for each job. Therefore, as compared with the case where various types of processing are performed every time the recording material is ejected as illustrated in FIG. 12 described above, the load on the controller 300 and the processing time required for the alignment processing are reduced. Therefore, in the above-described processing, it is possible to perform the alignment processing with high accuracy on the basis of the input condition such as the physical property value of the recording material and to form an image with high productivity.

Note that the above-described processing may be applied to the image forming system 10 having a configuration in which the medium sensor 533 is disposed on the downstream side of the image former 14, and the physical property value of the recording material may be acquired after the image formation.

For example, by changing the processing from steps S401 to S405 described above to the processing from steps S301 to S305 illustrated in FIG. 13, the physical property value of the recording material can be acquired by the medium sensor 533 after the image formation and the alignment processing can be performed.

<3. Second Embodiment of the Image Forming System and the Post-Processor>

Next, an embodiment (second embodiment) of the image forming system and the post-processor included in the image forming system will be described. Note that, in the following description, the description overlapping with that of the first embodiment described above will be omitted.

Figure 15:
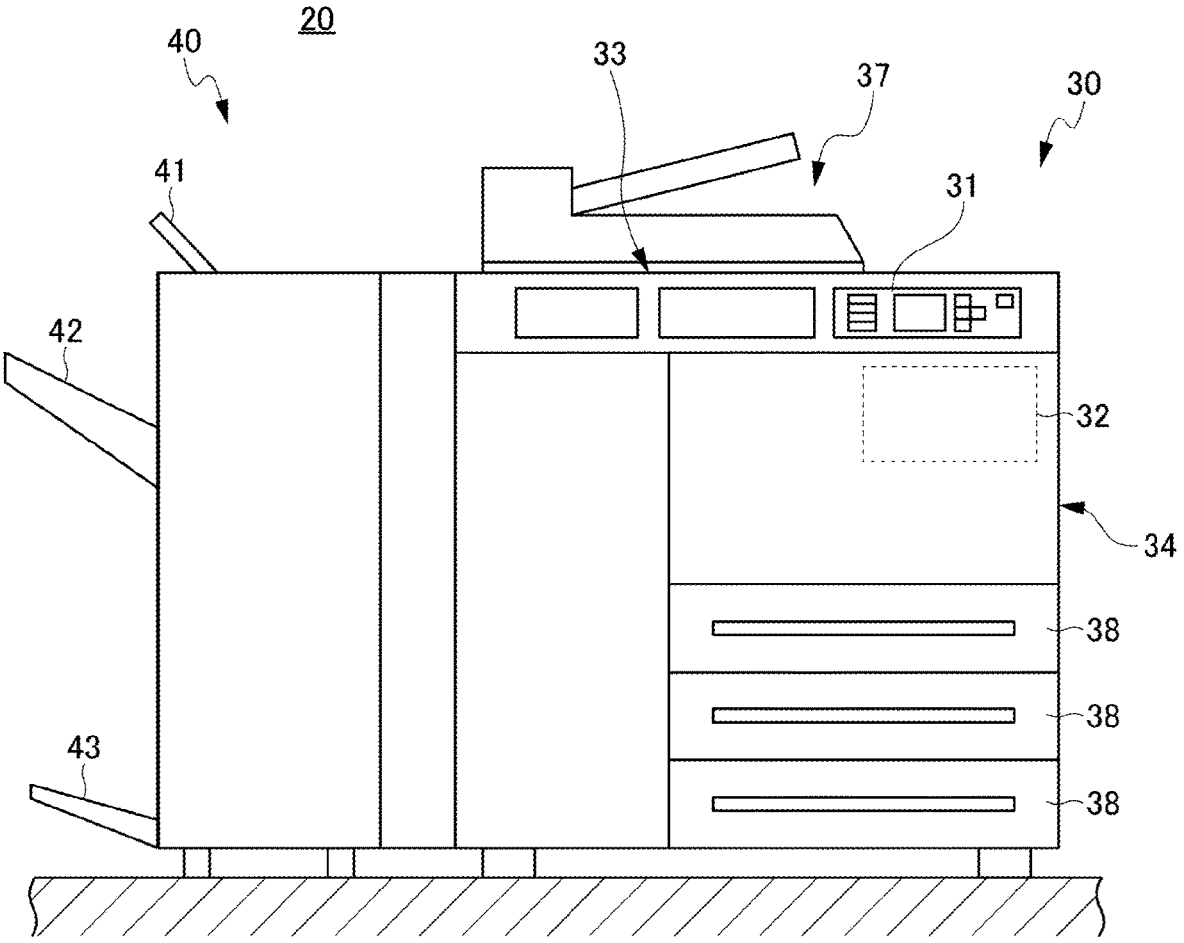
FIG. 15 is a schematic configuration diagram of an image forming system including a post-processor.

FIG. 15 illustrates a schematic configuration diagram of the image forming system. An image forming system 20 illustrated in FIG. 15 includes an image forming apparatus 30 and a post-processor 40 disposed on the downstream side of the image forming apparatus 30.

In the image forming apparatus 30 illustrated in FIG. 15, an image former 34 forms an image on a recording material conveyed from a paper feeder 38. Then, the recording material on which the image is formed is conveyed to the post-processor 40.

The post-processor 40 is connected to the image forming apparatus 30, and performs various types of post-processing such as side stitching processing and punch processing on the recording material on which the image has been formed in the image forming apparatus 30.

The recording material on which the image has been formed in the image forming apparatus 30 is carried into the post-processor 40. The carried-in recording material is subjected to post-processing designated by the user on an operation display 31, and is ejected to any one of a first paper ejection tray 41, a second paper ejection tray 42, and a third paper ejection tray 43.

[Image Forming Apparatus]

The image forming apparatus 30 is not particularly limited as long as it can form an image on the recording material and convey the recording material after the image formation to the post-processor 40 disposed on the downstream side, and the same configuration as that of the image forming apparatus described in the first embodiment described above can be applied except for the configuration of the paper ejection tray.

The image forming apparatus 30 illustrated in FIG. 15 includes the operation display 31 that receives various instructions by the user's operation and inputs of data such as characters and numbers and displays an instruction menu for the user, information regarding an acquired image, and the like, an image reader 33 that optically reads a document and obtains image data, the image former 34 that forms an image on the recording material on the basis of the image data, and the like. In addition, the image forming apparatus 30 includes an ADF 37 that automatically sends a document to the image reader 33 in an upper portion, the paper feeders 38 that supply the recording material to the image former 34 in a lower portion, and an image processor 32 that stores the image data and the like in a central portion.

[Configuration of the Post-Processor]

Figure 16:
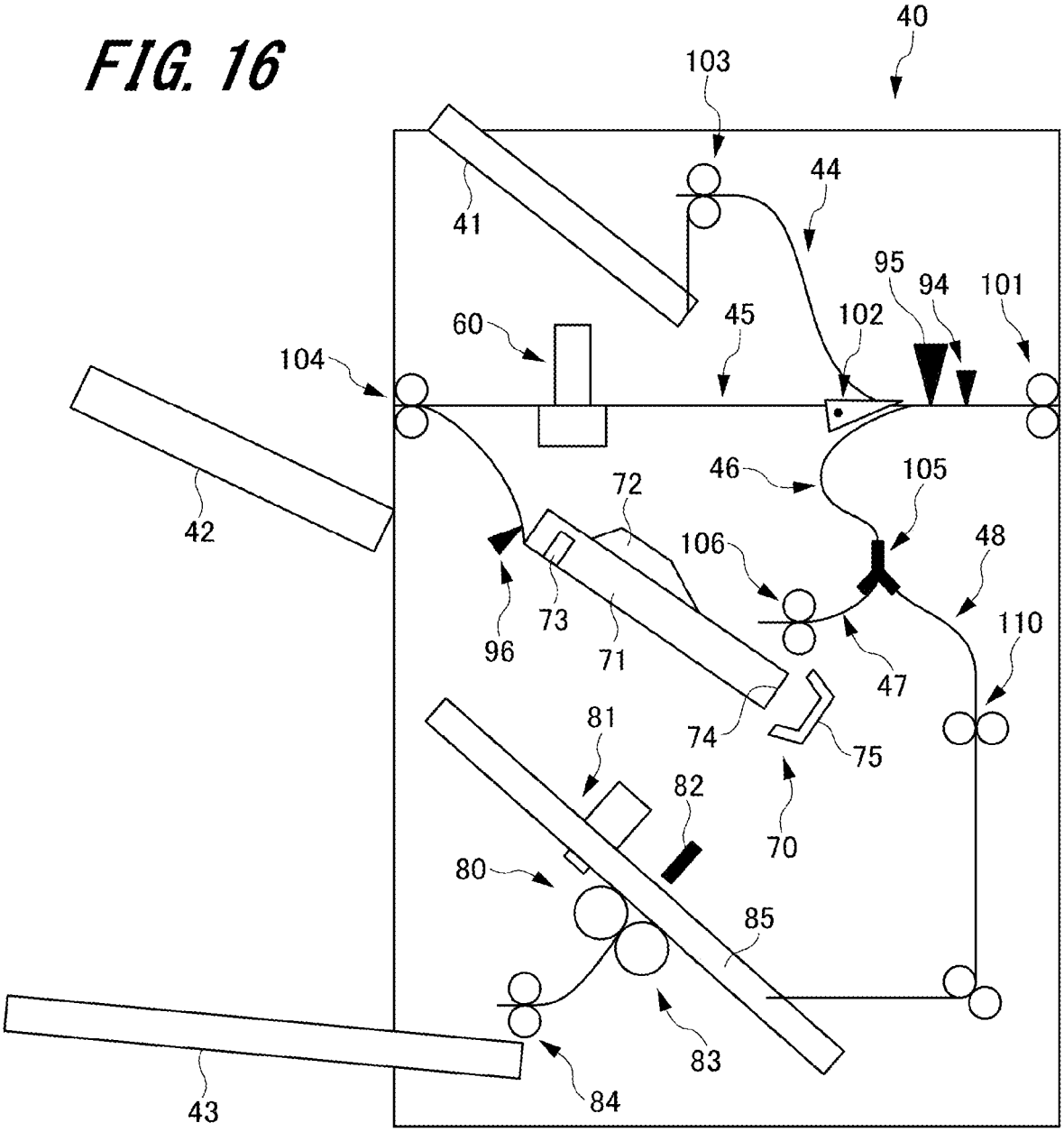
FIG. 16 is a diagram illustrating an internal configuration of a post-processor.

FIG. 16 illustrates an internal configuration of the post-processor 40. The post-processor 40 carries the recording material conveyed from the image forming apparatus 30 into the apparatus by a carry-in roller pair 101. A carry-in sensor 94 detects that the recording material carried into the post-processor 40 has arrived at the post-processor 40.

Next, the physical property value of the recording material that has passed through the carry-in sensor 94 is acquired by a medium sensor 95. For the configuration of the medium sensor 95 and the physical property value to be acquired, the same forms as those of the above-described first embodiment can be applied.

The position of a switch claw 102 is switched by a driver, which is not illustrated, and the recording materials whose physical property values have been acquired by the medium sensor 95 are distributed to a conveyance path 44, a conveyance path 45, and a conveyance path 46. In a case where the image forming job is to output a single document and no post-processing other than the alignment processing is performed on the recording material, the recording material is distributed to the conveyance path 44. The recording material distributed to the conveyance path 44 is discharged from a discharge roller pair 103 and loaded on the first paper ejection tray 41.

In addition, the recording materials distributed to the conveyance path 45 by the switch claw 102 are subjected to the punch processing one by one by a punch unit 60 as necessary, and are discharged from a discharge roller pair 104 to the second paper ejection tray 42. The recording material distributed to the conveyance path 46 by the switch claw 102 is distributed to a conveyance path 47 or a conveyance path 48 by switching the position of a switch claw 105 on the basis of the content of the post-processing instructed by the job.

The recording material distributed to the conveyance path 47 by the switch claw 105 is conveyed from a discharge roller pair 106 to a side stitching unit 70. The side stitching unit 70 includes a recording material loader 71, a width-direction aligner 72, a conveyance-direction aligner 73, a trailing end regulating plate 74, and a stapler 75.

The recording material stacked on the recording material loader 71 moves toward the trailing end regulating plate 74 by its own weight, and stops in a state where the trailing end of the recording material abuts on the trailing end regulating plate 74. In a state where the recording material is stopped in the recording material loader 71, the width-direction aligner 72 and the conveyance-direction aligner 73 tap the end of the recording material to move the recording material to a predetermined position to align the recording material.

The width-direction aligner 72 is movable in the width direction of the recording material by a driver, which is not illustrated. The width-direction aligner 72 moves back and forth in the width direction of the recording material in the vicinity of the end of the recording material in the width direction loaded on the recording material loader 71. Accordingly, the width-direction aligner 72 aligns the recording material by tapping the end of the recording material in the width direction.

The conveyance-direction aligner 73 is movable in the conveyance direction of the recording material by a driver, which is not illustrated.

The conveyance-direction aligner 73 moves back and forth in the conveyance direction of the recording material in the vicinity of the leading end of the recording material loaded on the recording material loader 71. Accordingly, the conveyance-direction aligner 73 aligns the recording material by tapping the leading end of the recording material.

The alignment processing operation by the width-direction aligner 72 and the conveyance-direction aligner 73 described above is performed according to the condition (alignment condition and operation parameter) of the alignment processing determined by a controller 90 (FIG. 17) to be described below based on the physical property value of the recording material acquired by the medium sensor 95. In addition, the alignment processing operation may be performed for each recording material in the recording material loader 71 or may be performed every time a predetermined number of recording materials are loaded.

When the number of recording materials set in the job is stacked on the recording material loader 71, the side stitching processing is performed on the recording material on the recording material loader 71 by the stapler 75. After completion of the side stitching processing, the recording material subjected to the side stitching processing is conveyed toward the discharge roller pair 104 and discharged from the discharge roller pair 104 to the second paper ejection tray 42. At this time, the conveyed recording material is detected by a paper ejection sensor 96. In addition, when the recording material subjected to the side stitching processing is conveyed toward the discharge roller pair 104, the conveyance-direction aligner 73 and the width-direction aligner 72 are retracted to positions not interfering with the conveyed recording material. When the paper ejection sensor 96 detects the trailing end of the recording material subjected to the side stitching processing, discharge of a subsequent recording material to the recording material loader 71 is started.

The recording material distributed to the conveyance path 48 by the switch claw 105 is conveyed to a saddle stitching unit 80. The saddle stitching unit 80 includes a stapler 81, a folding knife 82, a folding roller pair 83, discharge roller pair 84, and a recording material loader 85.

The recording material conveyed to the saddle stitching unit 80 is stopped at a predetermined position of the recording material loader 85. Then, the stapler 81 performs staple processing on the recording material. The recording material subjected to the staple processing is re-conveyed to a position where the stapled position and the position where the folding knife 82 is abutted overlap. The tip of the folding knife 82 abuts against the stopped recording material, and a fold is formed on the recording material.

The folding knife 82 moves in the direction of a nipper of the folding roller pair 83 in a state where the recording material is bent. Accordingly, the recording material is conveyed the fold side first to the folding roller pair 83. Then, a fold is further strongly formed on the recording material fed to the nipper of the folding roller pair 83. The recording material on which the fold is formed by the folding roller pair 83 is nipped and conveyed by the folding roller pair 83 as it is, and is ejected to the third paper ejection tray 43.

[Block Diagram]

Figure 17:
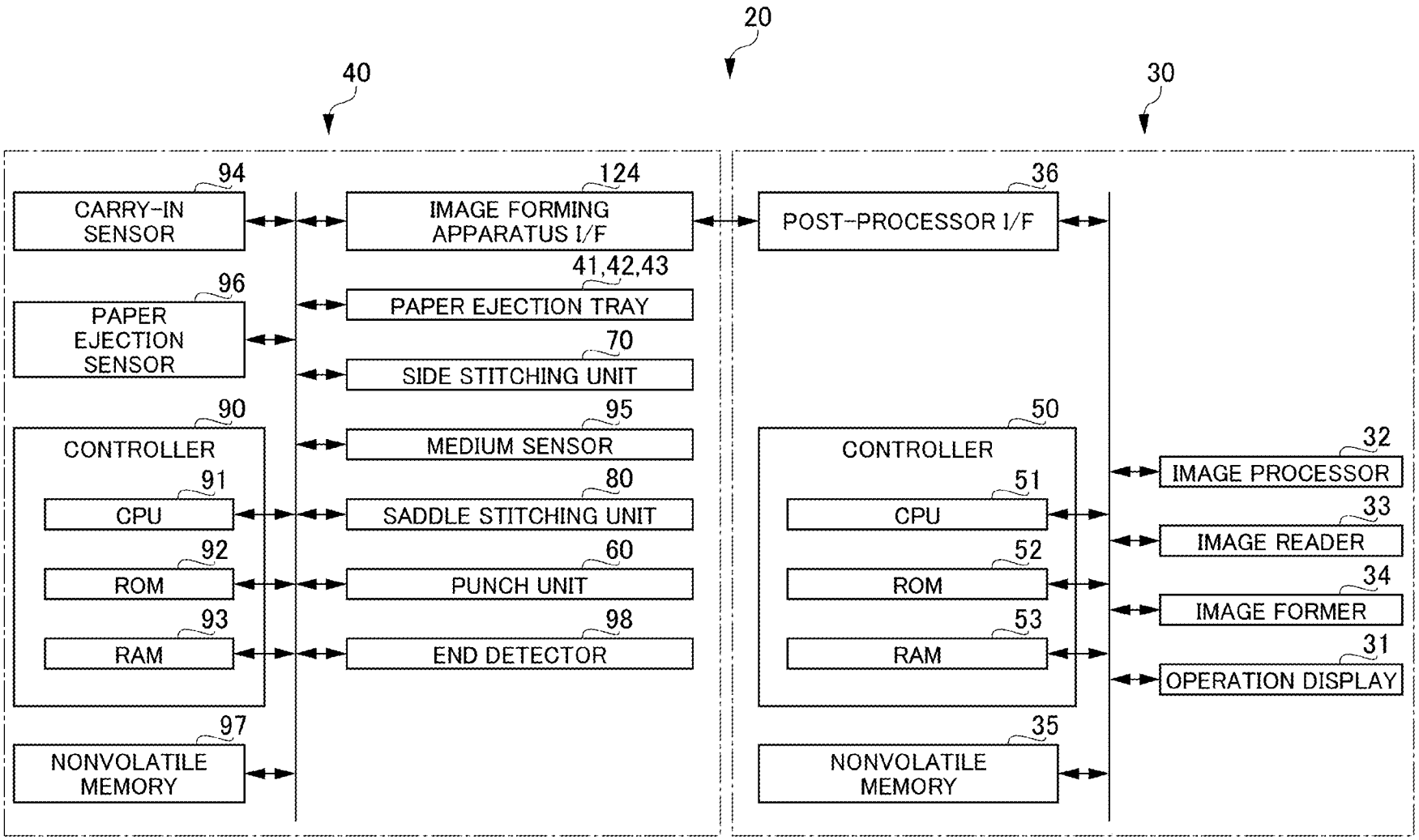
FIG. 17 is a block diagram illustrating a configuration example of an image forming system.

Next, FIG. 17 illustrates a block diagram of a configuration example of the image forming system 20. As illustrated in FIG. 17, the image forming system 20 includes the image forming apparatus 30 and the post-processor 40. In FIG. 17, configurations having functions equivalent to those in FIGS. 15 and 16 are denoted by the same reference numerals.

The image forming apparatus 30 includes the image processor 32, the image reader 33, the image former 34, the operation display 31, a controller 50, nonvolatile memory 35, a post-processor interface (I/F) 36, and the like.

The image reader 33 irradiates the document with light from a light source, which is not illustrated, and reads image data of the document image on the basis of the reflected light. The read image data is received by the image former 34 and stored in the nonvolatile memory 35.

The image processor 32 performs various types of image processing on the image data of the document image read by the image reader 33 and the image data stored in the nonvolatile memory 35.

The image former 34 forms an image on the recording material on the basis of the image data subjected to the image processing by the image processor 32.

The operation display 31 receives various settings related to the image formation and the post-processing on the recording material.

Furthermore, the operation display 31 displays an instruction menu for the user, information regarding the acquired image, and the like.

The controller 50 includes a CPU 51, ROM 52, and RAM 53. The CPU 51 integrally controls the entire operation of the image forming apparatus 30 by reading a program or data from the ROM 52 on the basis of information received from each unit in the image forming apparatus 30. The RAM 53 temporarily stores programs and data necessary for the CPU 51 to control the image forming apparatus 30.

The nonvolatile memory 35 stores image data and the like read by the image reader 33. In addition, the nonvolatile memory 35 stores image forming conditions set in an image forming job.

The post-processor I/F 36 transmits and receives various types of information to and from the post-processor 40.

The post-processor 40 includes the punch unit 60, the side stitching unit 70, the saddle stitching unit 80, the paper ejection trays 41, 42, and 43, the controller 90, the medium sensor 95, an image forming apparatus interface (I/F) 124, the carry-in sensor 94, the paper ejection sensor 96, nonvolatile memory 97, an end detector 98, and the like.

The controller 90 includes a CPU 91, ROM 92, and RAM 93. The CPU 91 reads programs and data from the ROM 92 and integrally controls the post-processor 40 on the basis of information received from each unit in the post-processor 40. The RAM 93 temporarily stores programs and data necessary for the CPU 91 to control the post-processor 40.

In addition, the controller 90 controls the alignment processing executed by the post-processor 40 and various post-processing other than the alignment processing. The control of the alignment processing can be executed similarly to the first embodiment described above. In addition, control of the various post-processing other than the alignment processing can be executed using a conventionally known method.

The medium sensor 95 acquires the physical property value of the recording material in the conveyance path of the recording material. The medium sensor 95 transmits the acquired physical property value of the recording material to the controller 90.

The end detector 98 detects the end of the recording material loaded on the recording material loader of the punch unit 60, the side stitching unit 70, the saddle stitching unit 80, and the paper ejection trays 41, 42, and 43, or the like. Then, the end detector 98 transmits information of the detected end of the recording material to the controller 90.

The image forming apparatus I/F 124 transmits and receives various types of information to and from the image forming apparatus 30. The controller 90 acquires image forming conditions, post-processing conditions, and the like set in the image forming job from the image forming apparatus 30 via the image forming apparatus I/F 124.

The nonvolatile memory 97 stores the image forming conditions, post-processing conditions, and the like set in the image forming job acquired from the image forming apparatus I/F 124.

Each of the carry-in sensor 94 and the paper ejection sensor 96 detects the recording material conveyed at the position illustrated in FIG. 16. Signals detected by the carry-in sensor 94 and the paper ejection sensor 96 are received by the controller 90. The controller 90 controls each unit of the post-processor 40 on the basis of the received signal.

[Description of the Alignment Processing Operation]

Figure 18:
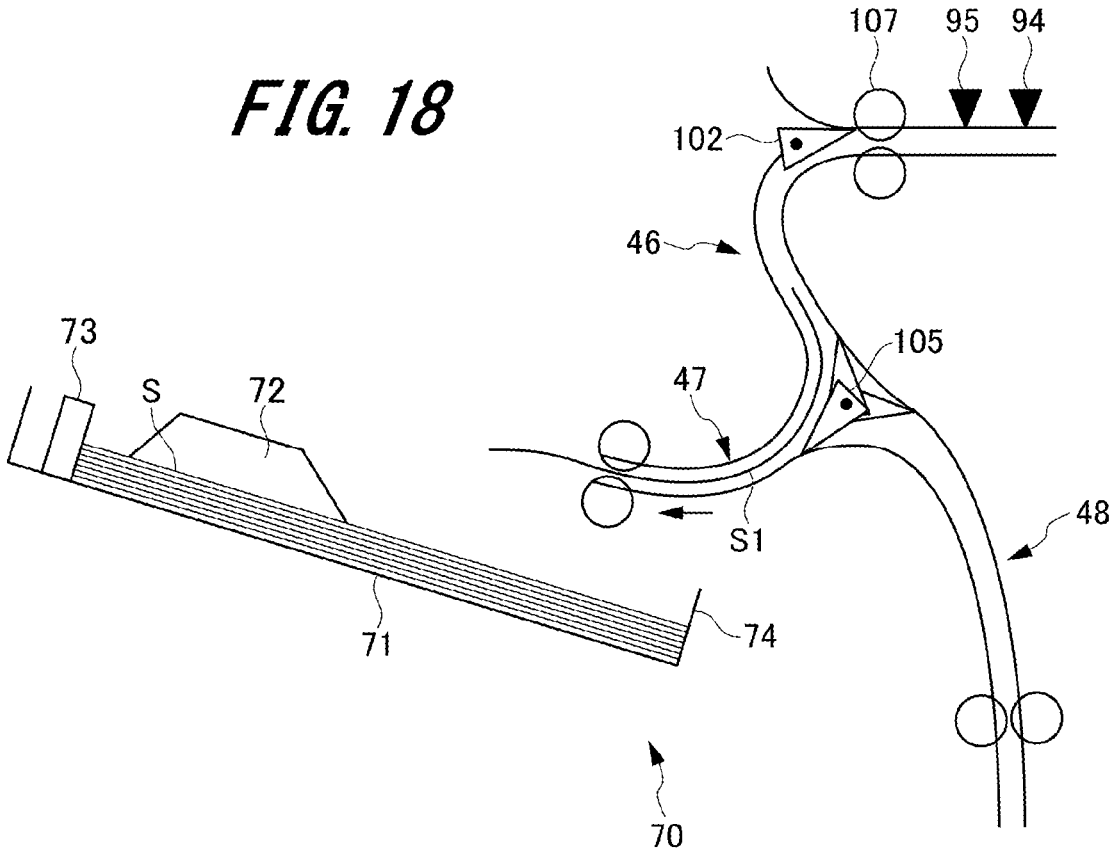
FIG. 18 is a diagram illustrating a configuration of a side stitching unit including a width-direction aligner and a conveyance-direction aligner.

Next, the recording material alignment processing operation in the side stitching unit 70 of the post-processor 40 will be described. FIG. 18 illustrates a configuration of the side stitching unit 70 including the width-direction aligner 72 and the conveyance-direction aligner 73. FIG. 18 illustrates a state in which a bundle of recording materials S is loaded on the recording material loader 71 in the side stitching unit 70. The alignment processing operation is controlled by the controller 90 based on the physical property value of the recording material acquired by the medium sensor 95.

When a recording material S1 is carried into the post-processor 40, the carry-in sensor 94 detects the leading end of the recording material S1 and transmits the arrival of the recording material S1 to the controller 90. Furthermore, the medium sensor 95 acquires the physical property value of the recording material S1 passing through the conveyance path, and transmits the acquired physical property value to the controller 90.

Next, when the recording material S1 is loaded on the recording material loader 71 from the conveyance path 47, the end detector 98, which is not illustrated, detects the end of the recording material S on the recording material loader 71. Accordingly, the end detector 98 detects the position information of the end of the recording material S before the alignment processing loaded on the recording material loader 71, and transmits the detected position information to the controller 90.

The controller 90 determines the alignment condition on the basis of the acquired physical property value of the recording material. The determination of the alignment condition can be performed similarly to the first embodiment described above. In addition, the controller 90 may determine the alignment condition on the basis of the information of the end of the recording material S acquired from the end detector 98 in accordance with the physical property value of the recording material. Furthermore, the controller 90 may acquire information such as an image forming condition and an environmental condition from the image forming apparatus 30 via the image forming apparatus I/F 124, and determine the alignment condition based on the acquired information and the physical property value of the recording material.

Next, the controller 90 drives the driver connected to the width-direction aligner 72 and the driver connected to the conveyance-direction aligner 73, moves the width-direction aligner 72 and the conveyance-direction aligner 73 to the central portion in accordance with the recording material S to perform the alignment processing in the conveyance direction and the width direction of the recording material S.

Each driver executes the alignment processing according to the alignment condition (operation parameter) determined by the controller 90.

By the above processing, the alignment processing of the recording material can be executed in the recording material loader 71 disposed in the post-processor 40.

As described above, also in the recording material loader 71 provided inside the post-processor 40, the alignment processing can be performed using the alignment condition determined based on the physical property value of the recording material. Although the configuration in which the aligners are provided only in the side stitching unit 70 has been described in the above description, the post-processor 40 may include the aligners on the other recording material loaders or each of the paper ejection trays 41, 42, and 43. For example, the post-processor 40 may include the aligners similar to those of the side stitching unit 70 described above on the saddle stitching unit 80, and perform the alignment processing using the aligners before the staple processing in the recording material loader 85 of the saddle stitching unit 80. In addition, the post-processor 40 may perform the alignment processing using the aligners with respect to the ejected recording material on each of the paper ejection trays 41, 42, and 43.

In addition, in the above description, the example has been described in which the determination of the alignment condition and the driving control are performed using the controller 90 of the post-processor 40, but these alignment processing may be performed by either the controller 50 of the image forming apparatus 30 or the controller 90 of the post-processor 40. The controller 50 of the image forming apparatus 30 and the controller 90 of the post-processor 40 may perform the driving control of the aligners in cooperation with each other by communicating with each other.

Note that the present invention is not limited to the configuration described in the above-described embodiment example, and various modifications and changes can be made without departing from the configuration of the present invention.

Although embodiments of the present invention have been described and illustrated in detail, the disclosed embodiments are made for purposes of illustration and example only and not limitation. The scope of the present invention should be interpreted by terms of the appended claims.

DESCRIPTION OF REFERENCE NUMERALS

10, 20 . . . image forming system
11 . . . operator
12 . . . display
13, 33 . . . image reader
14, 34 . . . image former
16 . . . communicator
17, 37 . . . ADF
18, 38 . . . paper feeder
19 . . . paper ejection tray
21 . . . paper ejection port
23 . . . information processor
30, 100 . . . image forming apparatus
31 . . . operation display
32 . . . image processor
35, 97, 312 . . . nonvolatile memory
36 . . . post-processor interface
40, 200 . . . post-processor
41 . . . first paper ejection tray
42 . . . second paper ejection tray
43 . . . third paper ejection tray
44, 45, 46, 47, 48 . . . conveyance path
50, 90, 203, 300 . . . controller
51, 91, 321 . . . CPU
52, 92, 322 . . . ROM
53, 93, 323 . . . RAM
60 . . . punch unit
70 . . . side stitching unit
71, 85 . . . recording material loader
72 . . . width-direction aligner
73 . . . conveyance-direction aligner
74 . . . trailing end regulating plate
75, 81 . . . stapler
80 . . . saddle stitching unit
82 . . . folding knife
83 . . . folding roller pair
84, 103, 104, 106 . . . discharge roller pair
94 . . . carry-in sensor
95, 533 . . . medium sensor
96, 536 . . . paper ejection sensor
98, 204 . . . end detector
101 . . . carry-in roller pair
102, 105 . . . switch claw
124 . . . image forming apparatus interface
201 . . . aligner
202 . . . driver
205 . . . sensor
206 . . . camera
207 . . . guide plate
211 . . . receiver
212 . . . alignment state detector
213 . . . loaded paper number detector
214 . . . parameter storage
215 . . . alignment condition determiner
302 . . . facsimile
303 . . . communication controller
308 . . . data inputter/outputter
309 . . . data communication controller
313 . . . image memory
315 . . . LAN terminal
316 . . . USB terminal
317 . . . parallel interface terminal
318 . . . serial interface terminal
501 . . . imager
502 . . . intermediate transfer belt
503*a* . . . photoconductor
504*a* . . . developer
505*a* . . . charger
506*a* . . . exposurer
507 . . . intermediate transfer belt cleaner
508 . . . paper feeding roller
510 . . . timing roller
511 . . . secondary transfer roller
512 . . . fixing roller
512*a* . . . heating roller
512*b* . . . pressure roller
513 . . . paper ejection roller
514*a* . . . duplex path conveyance roller
515 . . . waste toner BOX
520 . . . conveyor
525*a* . . . toner bottle
526*a* . . . stirring blade
528*a* . . . cartridge
529 . . . duplex conveyance path
530 . . . static elimination cloth
531*a* . . . toner sensor
532 . . . paper feeding sensor
534*a* . . . primary transfer roller
535 . . . environment detector
S, S1 . . . recording material

The invention claimed is:

1. A post-processor comprising:

a recording material loader on which a recording material conveyed through a conveyance path is loaded;

an aligner that aligns the recording material in the recording material loader;

a driver that moves the aligner; and a controller that receives information of a physical property value of the recording material acquired by a medium sensor and determines an alignment condition of alignment processing that drives the driver based on the information of the physical property value, wherein the controller determines the alignment condition based on a history of the alignment condition.

2. The post-processor according to claim 1, wherein the controller determines the alignment condition based on at least one or more pieces of information of an image forming condition with respect to the recording material, a number of the recording materials on which the alignment processing is performed, and an operation environment together with the information of the physical property value.

3. The post-processor according to claim 1, comprising:

an end detection sensor that detects an end of the loaded recording material in the recording material loader, wherein the controller includes an alignment state detector that detects an alignment state of the loaded recording material based on information of the end of the recording material detected by the end detection sensor, and the controller determines the alignment condition of the alignment processing that drives the driver based on the information of the physical property value of the recording material and the alignment state.

4. The post-processor according to claim 2, comprising:

a parameter storage that stores the generated alignment condition, wherein the controller determines the alignment condition based on history of the alignment condition stored in the parameter storage.

5. The post-processor according to claim 4, wherein the parameter storage stores the determined alignment condition, and at least one or more pieces of information selected from the information of the physical property value, the image forming condition, the number of recording materials, and the operation environment used for determining the alignment condition.

6. The post-processor according to claim 5, wherein the controller determines the alignment condition as an output when the information of the physical property value is input by using a learned model obtained by performing machine learning based on the information of the physical property value and the alignment condition history stored in the parameter storage.

7. The post-processor according to claim 6, wherein the controller determines the alignment condition as an output when the information of the physical property value and at least one or more pieces of information selected from the image forming condition, the number of recording materials, and the operation environment are input using a learned model obtained by performing machine learning based on the information of the physical property value, at least one or more pieces of information selected from the image forming condition, the number of recording materials, and the operation environment, and the alignment condition history stored in the parameter storage.

8. The post-processor according to claim 7, comprising:

an end detection sensor that detects an end of the loaded recording material in the recording material loader, wherein the controller includes an alignment state detector that detects an alignment state of the loaded recording material based on information of the end of the recording material detected by the end detection sensor, and the controller determines the alignment condition as an output when the information of the physical property value, the alignment state of the recording material, and at least one or more pieces of information selected from the image forming condition, the number of recording materials, and the operation environment are input using a learned model obtained by performing machine learning based on the information of the physical property value, the alignment state of the recording material, at least one or more pieces of information selected from the image forming condition, the number of recording materials, and the operation environment, and the alignment condition history stored in the parameter storage.

9. The post-processor according to claim 1, wherein the aligner aligns at least one of an end in a direction parallel to a conveyance direction of the recording material and an end in a direction orthogonal to the conveyance direction of the recording material.

10. The post-processor according to claim 1, wherein the controller determines, as the alignment condition, at least one or more drive conditions selected from a number of times of operation of the aligner, a moving speed of the aligner, an amount of movement of the aligner, and a drive torque of the driver.

11. The post-processor according to claim 1, wherein the controller receives at least one of smoothness, rigidity, and thickness as the information of the physical property value of the recording material from the medium sensor.

12. The post-processor according to claim 1, wherein the controller receives at least one of charge amount, water content, and paper grain as the information of the physical property value of the recording material from the medium sensor.

13. The post-processor according to claim 1, wherein the medium sensor is disposed on the conveyance path.

14. The post-processor according to claim 2, wherein the controller determines the operation parameter based on at least one or more pieces of information selected from basis weight, size, type, printing surface, and coverage of the recording material as image forming conditions.

15. The post-processor according to claim 3, wherein the alignment state detector detects at least one of an alignment state during the alignment processing of the recording material and an alignment state after the alignment processing.

16. The post-processor according to claim 3, wherein the alignment state detector detects the alignment state of the recording material twice or more during the alignment processing.

17. The post-processor according to claim 1, wherein the aligner is provided in the recording material loader on which the ejected recording material is loaded.

18. An image forming system including an image forming apparatus and a post-processor, comprising:

an image former that forms an image on a recording material and is provided in the image forming apparatus;

a recording material loader on which the recording material conveyed from the image former through a conveyance path is loaded and that is provided in the post-processor;

an aligner that aligns at least one end of leading and trailing ends in a direction parallel to a conveyance direction of the recording material and side ends in a direction orthogonal to the conveyance direction in the recording material loader and is provided in the post-processor;

a driver that moves the aligner and is provided in the post-processor;

a medium sensor that acquires a physical property value of the recording material and is provided in at least one of the image forming apparatus and the post-processor; and a controller that determines an alignment condition of alignment processing that drives the driver based on information of the physical property value of the recording material acquired by the medium sensor, wherein the controller determines the alignment condition based on a history of the alignment condition.

* * * * *